US011884499B1

(12) United States Patent
Austin et al.

(10) Patent No.: US 11,884,499 B1
(45) Date of Patent: Jan. 30, 2024

(54) APPARATUS AND METHODS FOR VARIABLE WIDTH TURN-UP PROCEDURES ON A PAPER PROCESSING MACHINE

(71) Applicant: Sandar Industries, Inc., Atlantic Beach, FL (US)

(72) Inventors: Craig Austin, Jacksonville, FL (US); Peter A. Rodriguez, Jacksonville, FL (US); Jason Rodriguez, Jacksonville, FL (US); Richard Tyler Cernich, Jacksonville, FL (US)

( * ) Notice: Subject to any disclaimer, the term of this patent is extended or adjusted under 35 U.S.C. 154(b) by 0 days.

(21) Appl. No.: 18/168,498

(22) Filed: Feb. 13, 2023

(51) Int. Cl.
*B65H 19/22* (2006.01)

(52) U.S. Cl.
CPC ..... *B65H 19/22* (2013.01); *B65H 2301/4146* (2013.01); *B65H 2801/84* (2013.01)

(58) Field of Classification Search
CPC ..... B65H 19/22; B65H 19/28; B65H 18/08; B65H 2301/4146; B65H 2801/84
See application file for complete search history.

(56) References Cited

U.S. PATENT DOCUMENTS

| | | | | |
|---|---|---|---|---|
| 5,046,675 | A * | 9/1991 | Rodriguez | B65H 19/262 242/542.3 |
| 5,467,937 | A * | 11/1995 | Rodriquez | B65H 35/006 242/615.3 |
| 5,954,290 | A * | 9/1999 | Rodriguez | B65H 19/262 242/542.3 |
| 6,305,634 | B1 * | 10/2001 | Rodriguez | B65H 19/262 242/526.2 |
| 6,416,012 | B1 * | 7/2002 | Wilmoth | B65H 19/262 226/166 |
| 6,575,395 | B2 * | 6/2003 | Rodriguez | B65H 19/262 242/526.2 |
| 9,102,491 | B2 * | 8/2015 | Rodriguez | B65H 19/262 |
| 2014/0021285 | A1 * | 1/2014 | Rodriguez | B65H 19/283 242/526.2 |

* cited by examiner

*Primary Examiner* — Sang K Kim
(74) *Attorney, Agent, or Firm* — Joseph P. Kincart

(57) ABSTRACT

Apparatus for variable width turn-up procedures on a paper processing machine. The apparatus may include a turn-up tape dispenser fixedly attached to a proximal end of a transverse track and movable with the transverse track along the first linear bearing. A movable turn-up tape exit point may be mounted to a second linear bearing. The second linear bearing may be independent of the transverse track or attached to the transverse track. The apparatus may include a brake operable to secure the transverse track in a position relative to the surface of the first spool. Furthermore, the apparatus may include a movable track curve that allows a placement of the track curve to be moved.

10 Claims, 19 Drawing Sheets

1600

| |
|---|
| SUPPORT A TRANSVERSE TRACK CAPABLE OF CONTAINING A PAPERBAND WITH A FIRST LATERAL BEARING<br>**1602** |
| EXTEND THE DISTAL END OF TRANSVERSE TRACK ACROSS THE LATERAL BEARING TO A FIRST LENGTH BASED UPON A WIDTH OF A FIRST PAPER WEB<br>**1604** |
| PLACE A TRACK CURVE AT THE DISTAL END OF THE TRANSVERSE TRACK IN A FIRST TRACK CURVE POSITION THAT IS SUITABLE TO PERFORM A TURN-UP PROCEDURE ON THE FIRST PAPER WEB<br>**1606** |
| FEED A FIRST PORTION OF PAPERBAND INTO THE PROXIMAL END OF THE TRANSVERSE TRACK, THROUGH THE TRANSVERSE TRACK, AND INTO THE TRACK CURVE IN A FIRST TRACK CURVE POSITION<br>**1608** |
| POSITION A TURN-UP TAPE EXIT POINT ALONG A SECOND LATERAL BEARING TO A FIRST EXIT POINT POSITION BASED UPON THE WIDTH OF THE FIRST PAPER WEB TO BE PROCESSED<br>**1610** |
| ATTACH THE PAPERBAND TO A LOCATION ON A FIRST EMPTY SPOOL SUITABLE FOR PERFORMING A TURN-UP PROCEDURE ON THE FIRST PAPER WEB TO BE PROCESSED<br>**1612** |
| EXIT THE PAPERBAND FROM THE TRANSVERSE TRACK AT THE FIRST EXIT POINT POSITION<br>**1614** |
| PERFORM A FIRST TURN-UP PROCEDURE ON THE FIRST PAPER WEB TO BE PROCESSED WITH THE TRACK CURVE IN THE FIRST TRACK CURVE POSITION AND THE EXIT POINT AT THE FIRST EXIT POINT POSITION<br>**1616** |

FIG. 16

APPARATUS AND METHODS FOR VARIABLE WIDTH TURN-UP PROCEDURES ON A PAPER PROCESSING MACHINE

FIELD OF DISCLOSURE

The present invention relates generally to apparatus and methods for more reliable and consistent high-speed severing and transfer of a rapidly advancing paper web from a rotating Parent Web Spool onto an Empty Web Spool, and more particularly to apparatus.

BACKGROUND

The modern industrial paper machine includes a continuous manufacturing process that forms a sheet of paper and winds the newly formed sheet of paper on a steel spindle or spool sometimes coated with a rubber or fibrous sheath spinning with significant force as the paper roll reaches a desired maximum diameter. In order to transfer a newly formed web of paper from a first spool with a full roll of paper to an empty spool that will continue to wind the paper requires a turn-up process. The turn-up process severs the moving web of paper and transfers it to the empty spool.

A paperband-based turn-up system tears a continuously manufactured or processed web or sheet and binds it to a new empty spool. This is accomplished by passing a strong ribbon of paperband (which may be referred to herein as a turn-up tape) through a track oriented transversely and below the web and then through a curved track that presents the end of the ribbon to the nip point between the new empty spool and the reel drum. When one end of the paperband adheres to the empty spool, and resistance is applied to an opposite end of the paperband, the paperband is drawn taught and pulls through the paper web from underneath tearing through the paper web. The paper web is then bound to the empty spool.

Continuous process machinery used to laminate separate webs into engineered composites, or to apply coatings to one web or a lamination of separate webs are referred to as converting machines.

An end product of a converting machine varies in specification according to the needs of the client. Depending on the client's specification and the feed stock available, a converting machine may be adapted to process a paper web of typically between 50% and 100% of a width the converting machine is designed to process.

Paperband-based turn-up systems seek to optimize the efficiency of a spool change process. Optimization may be directed towards one or both of saving salable tonnage of the paper web and may reduce inefficient use of the consumable paperband.

A design of paperband turn-up system installation preferably seeks to inject the paperband into a spool-reel drum nip as close to an edge of the paper web as practical. To control a length of a free end of paperband, an exit point of a paperband track is typically positioned very near an edge of a trim of the paper web.

Proper positioning of a paperband track curve and exit point serves to reduce a free length of paperband on either side. If a free length of paperband is left too long, the free length of paperband may whip around the spool and nick an edge of the paper web with the potential of tearing the paper web before the paper web is securely attached to a new spool.

Nicking or slashing of the paper web before secure attachment to a new spool results in a significant waste of new paper web since such slashing requires that the finished paper web product being manufactured be diverted to a recycling bin during such time as is needed to rethread the paperband and perform a subsequent turn-up procedure. Such diversion to recycling wastes paper web material, which cuts into profitability.

Processing various web widths in converting machines exacerbates the problem of arranging for a proper length of a free end of the paperband while processing a narrow paper web. With an exit point of the turn-up band track positioned properly in relation to the edge of the paper web, a free end of a paperband is captured between subsequent layers of the paper web as the paper web is wound on a spool. If the exit point of the paperband from a paperband track remains at a position optimal for processing a wide paper web, and a turn-up is attempted on a narrow paper web, an unnecessary length of a free end of the paperband is not easily controlled. In such a case, a likelihood of the free end of the paperband whipping and slashing the paper web is increased.

Another consideration in processing relatively thick laminations is that a resulting gap between a reel drum and an empty spool may be too wide to press a leading end of the turn-up tape (which is typically treated with an adhesive) to the spool and a desired turn-up cannot be achieved.

Previous attempts to address the foregoing problems by repositioning segments of the transverse track such that the transverse track may be shortened, thus repositioning the track curve and the exit point closer to the respective edges of a paper web being processed. However, such attempts required disconnecting an associated turn-up tape dispenser unit (either moving it laterally or removing it from the transverse track altogether), pulling the separate transverse track sections off of an associated spine, repositioning the turn-up tape track curve, replacing the separate transverse track sections and exit point, and reconnecting the dispenser unit. Although sometimes effective, such a process was time-consuming and required work within the confines of the paper making or converting machine, which is also dangerous.

Inefficiency is also inherent in the previous attempts to address the problems of variable width webs and/or variable thickness webs, in that unless multiple web widths are established in advance, and interchangeable track sections are planned accordingly, a positioning of an associated exit point, and critical placement of the track curve relative to an edge of the web, is an approximation at best, resulting in inefficiency of the turn-up procedure and nicking or slashing of the paper web. Such an approximation by incremental adjustments limits a converting machine's adaptability to client specifications.

Existing techniques for improved turn-up procedures on a paper processing machine are deficient in several ways. Therefore, there is a need for apparatuses and methods for variable width turn-up procedures on a paper processing machine that may overcome one or more of the above-mentioned problems and/or limitations.

SUMMARY OF DISCLOSURE

The present disclosure provides apparatus for variable width turn-up procedures on a paper processing machine. Also, the apparatus may include a transverse turn-up tape track mounted on a first linear bearing and extended parallel to a surface of a first spool suitable for receiving a paper web. Further, said transverse turn-up tape track may be sized to contain a turn-up tape and movable along the first linear bearing. Further, the apparatus may include a turn-up tape dispenser fixedly attached to a proximal end of a transverse track and movable with the transverse track along the first linear bearing. Additionally, the apparatus may include a track curve attached to a distal end of the transverse track. Also, the apparatus may include a movable turn-up tape exit device mounted to a second linear bearing. Further, said second linear bearing may be attached to the transverse track. Further, the apparatus may include a brake operable to secure the transverse track in a position relative to the surface of the first spool.

The present disclosure provides apparatus for variable width turn-up procedures on a paper processing machine. Accordingly, the apparatus may include a transverse turn-up tape track mounted on a first linear bearing and extended parallel to a surface of a first spool suitable for receiving a paper web. Further, said transverse turn-up tape track may be movable along the first linear bearing and sized to contain a turn-up tape. Furthermore, the apparatus may include a turn-up tape dispenser fixedly attached to a proximal end of a transverse track and movable with the transverse track along the first linear bearing. Moreover, the apparatus may include a track curve attached to a distal end of the transverse track. Accordingly, the apparatus may include a movable turn-up tape exit device mounted to a second linear bearing. Further, said second linear bearing may be attached to a linear track independent of the transverse track. Furthermore, the apparatus may include a brake operable to secure the transverse track in a position relative to the surface of the first spool during a turn-up procedure.

The present disclosure provides a method for improved turn-up procedures on a paper processing machine. Additionally, the method may include extending a transverse turn-up tape track along a first lateral bearing to a length based on a width of a paper web. Additionally, the method may include positioning a turn-up tape exit device along a second lateral bearing to a position based on the width of the paper web. Additionally, the method may include extending a transverse turn-up tape track parallel to a first spool to a track curve. Additionally, the method may include setting the track curve at a lower position that does not interfere with the paper web during threading. Additionally, the method may include threading a paper web threading leader past a reel drum to the first spool. Additionally, the method may include spooling the paper web threading leader onto the first spool until a full width of the paper web may be spooling onto the first spool. Additionally, the method may include transitioning the track curve from the lower position that does not interfere with the paper web during threading to a turn-up position, while maintaining the transverse turn-up tape track essentially stationary relative to the first spool. Accordingly, the transitioning may be performed after the full width of the paper web may have begun spooling onto the first spool.

This summary is provided to introduce a selection of concepts in a simplified form, that are further described below in the Detailed Description. This summary is not intended to identify key features or essential features of the claimed subject matter. Nor is this summary intended to be used to limit the claimed subject matter's scope.

Both the foregoing summary and the following detailed description provide examples and are explanatory only. Accordingly, the foregoing summary and the following detailed description should not be considered to be restrictive. Further, features or variations may be provided in addition to those set forth herein. For example, embodiments may be directed to various feature combinations and subcombinations described in the detailed description.

BRIEF DESCRIPTIONS OF DRAWINGS

The accompanying drawings, which are incorporated in and constitute a part of this disclosure, illustrate various embodiments of the present disclosure. The drawings contain representations of various trademarks and copyrights owned by the Applicants. In addition, the drawings are being used for illustrative purposes only.

Furthermore, the drawings may contain text or captions that may explain certain embodiments of the present disclosure. This text is included for illustrative, non-limiting, explanatory purposes of certain embodiments detailed in the present disclosure.

Figure 6:
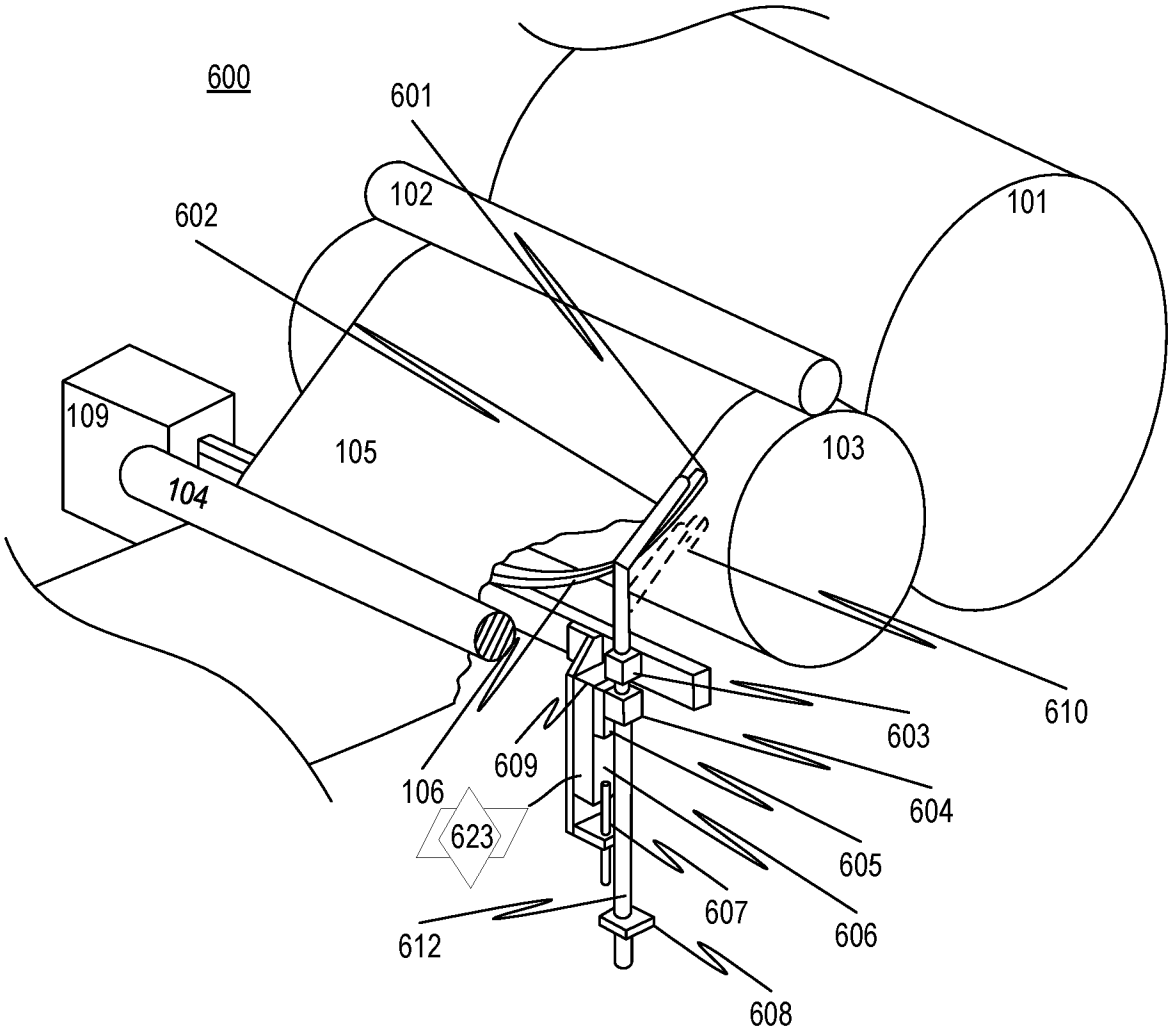
Figure 6A:
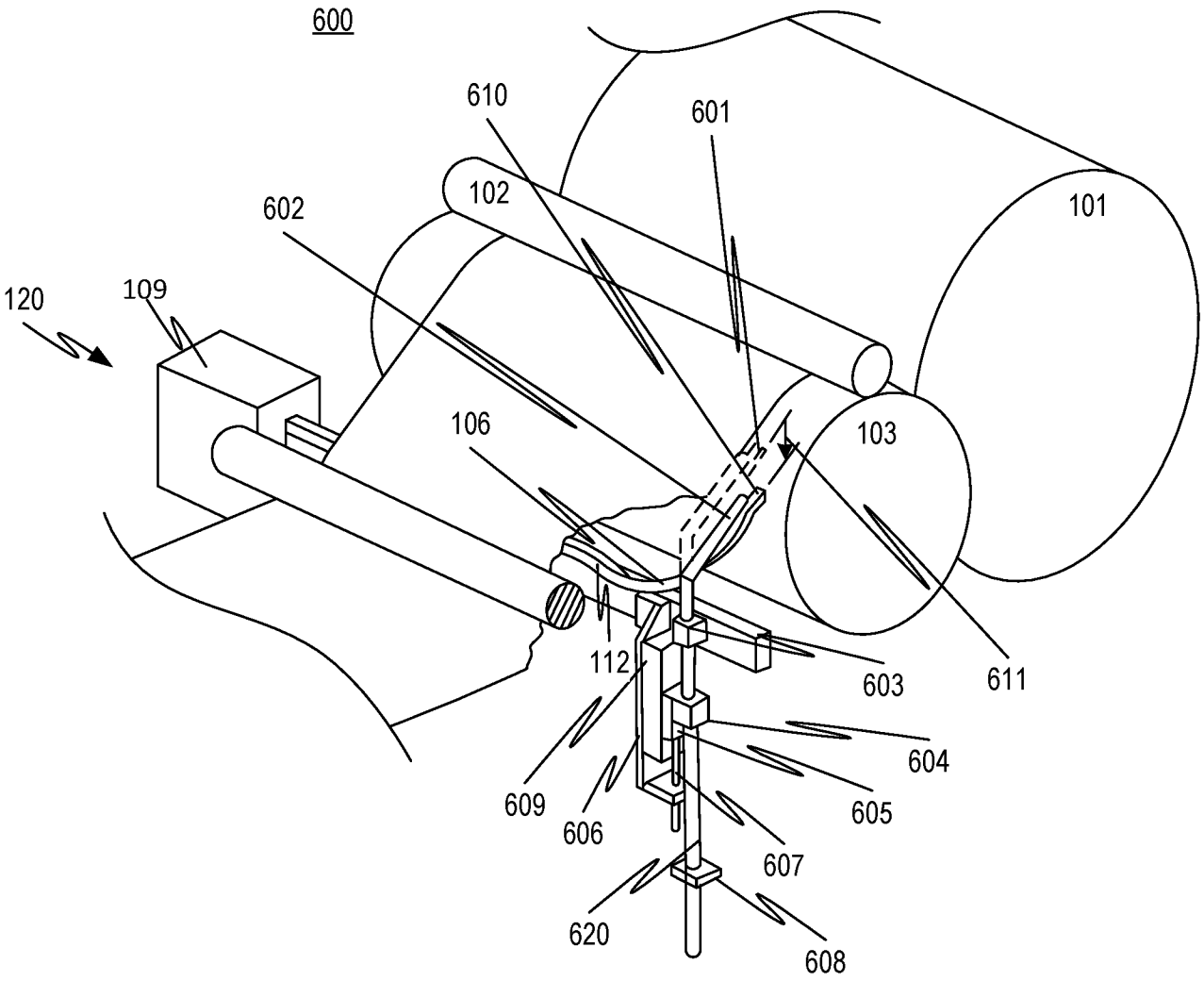
Figure 6B:
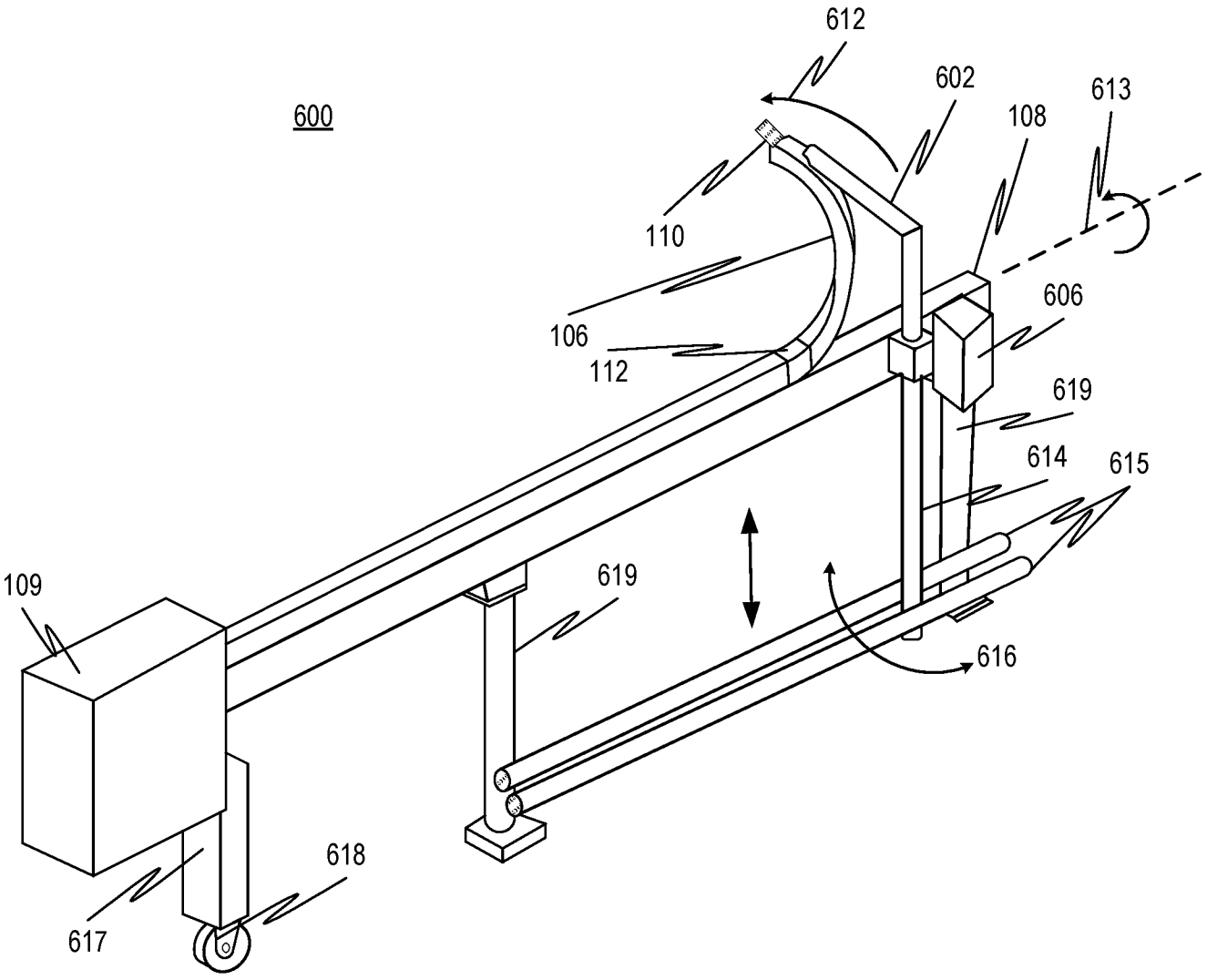

FIGS. 6, 6A, and 6B illustrate views of a Paper Making Apparatus with a Track Curve movable from a first position to a second position, in accordance with some embodiments of the present invention.

Figure 7:
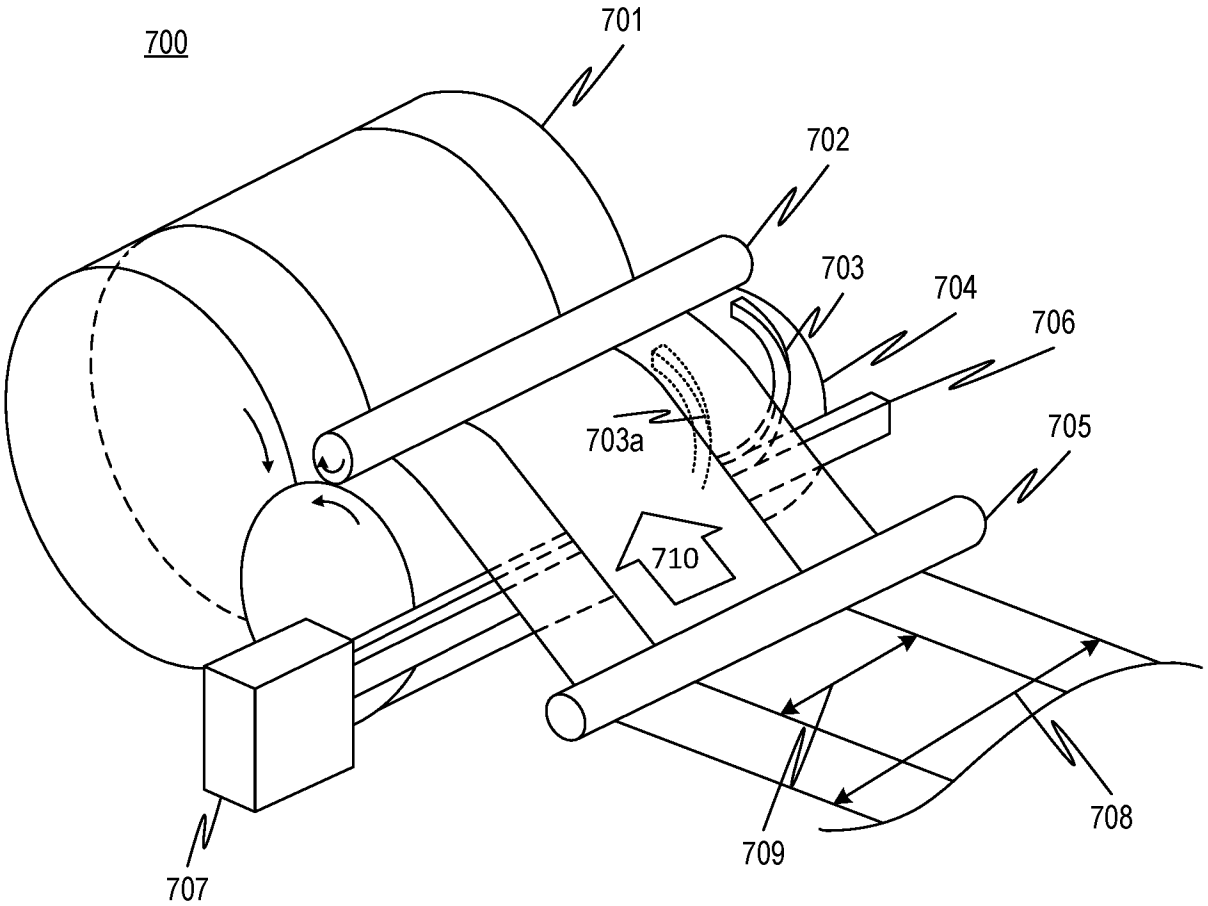

FIG. 7 illustrates a schematic diagram of paperwebs with disparate widths spooling onto a Full Spool.

Figure 8:
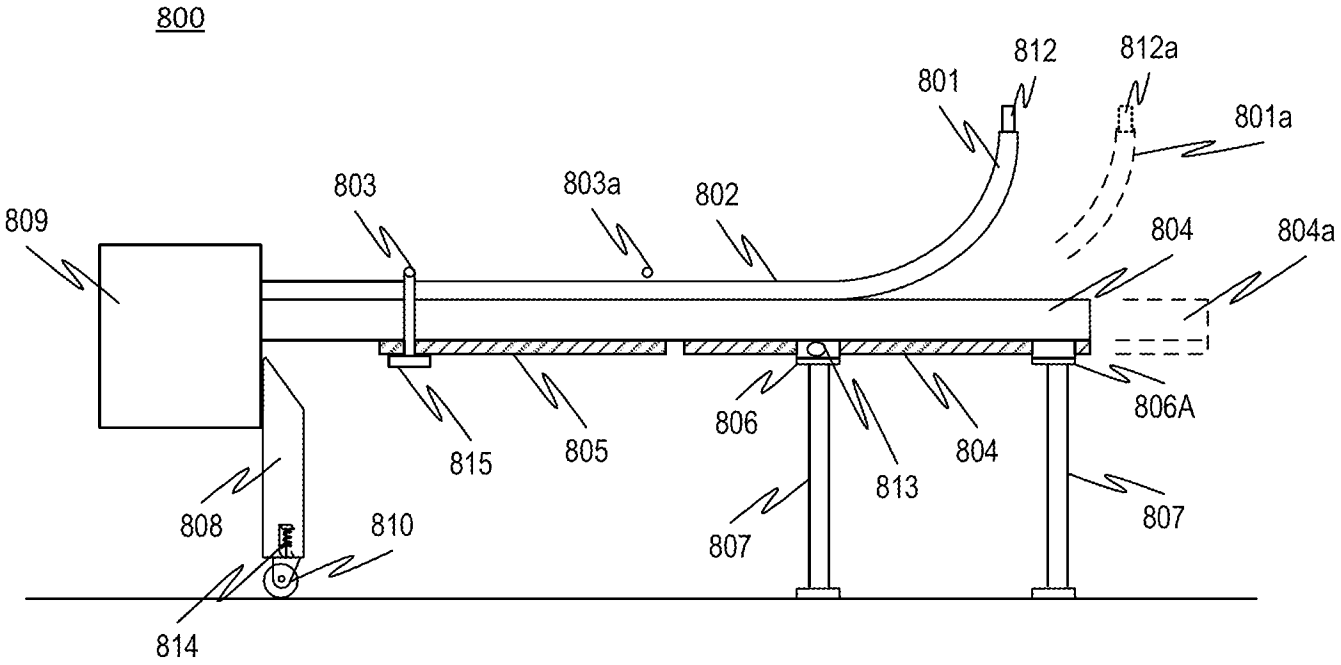

FIG. 8 illustrates an elevation schematic diagram of an exemplary adjustable position curved track apparatus at a first position, in accordance with some embodiments of the present invention.

Figure 9:
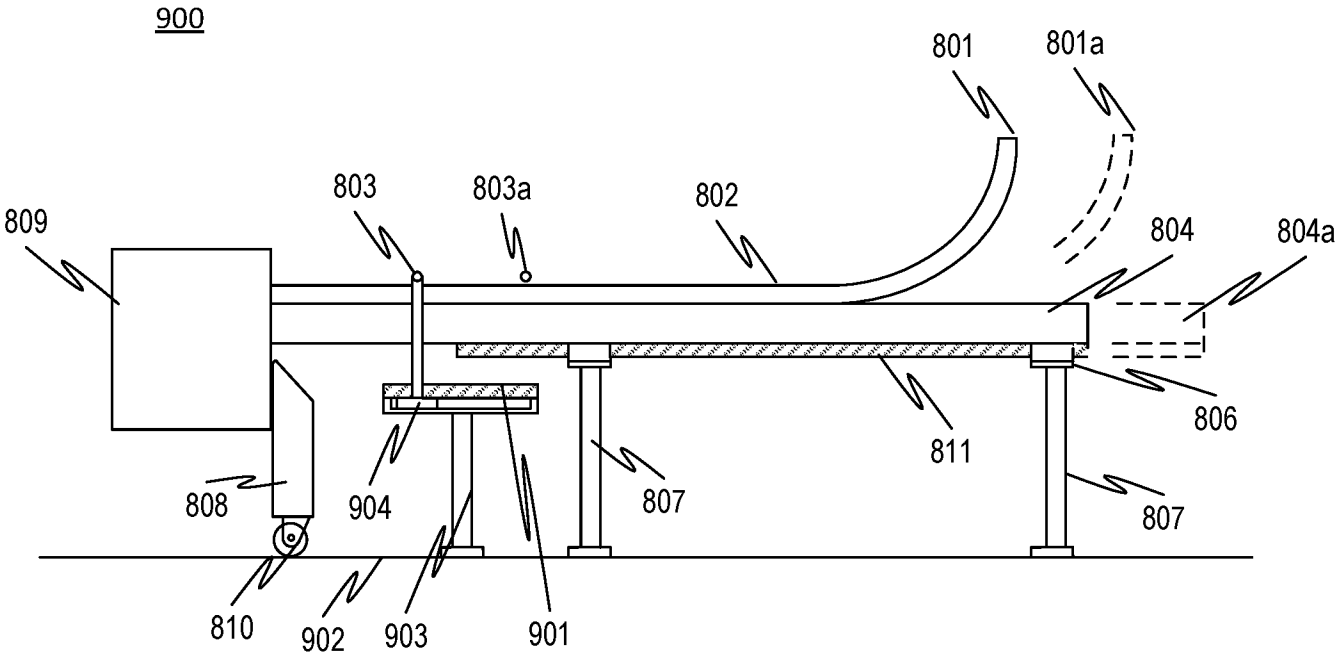

FIG. 9 illustrates an elevation schematic diagram of an exemplary adjustable position curved track apparatus at a second position relative to the first position, in accordance with some embodiments of the present invention.

Figure 10:
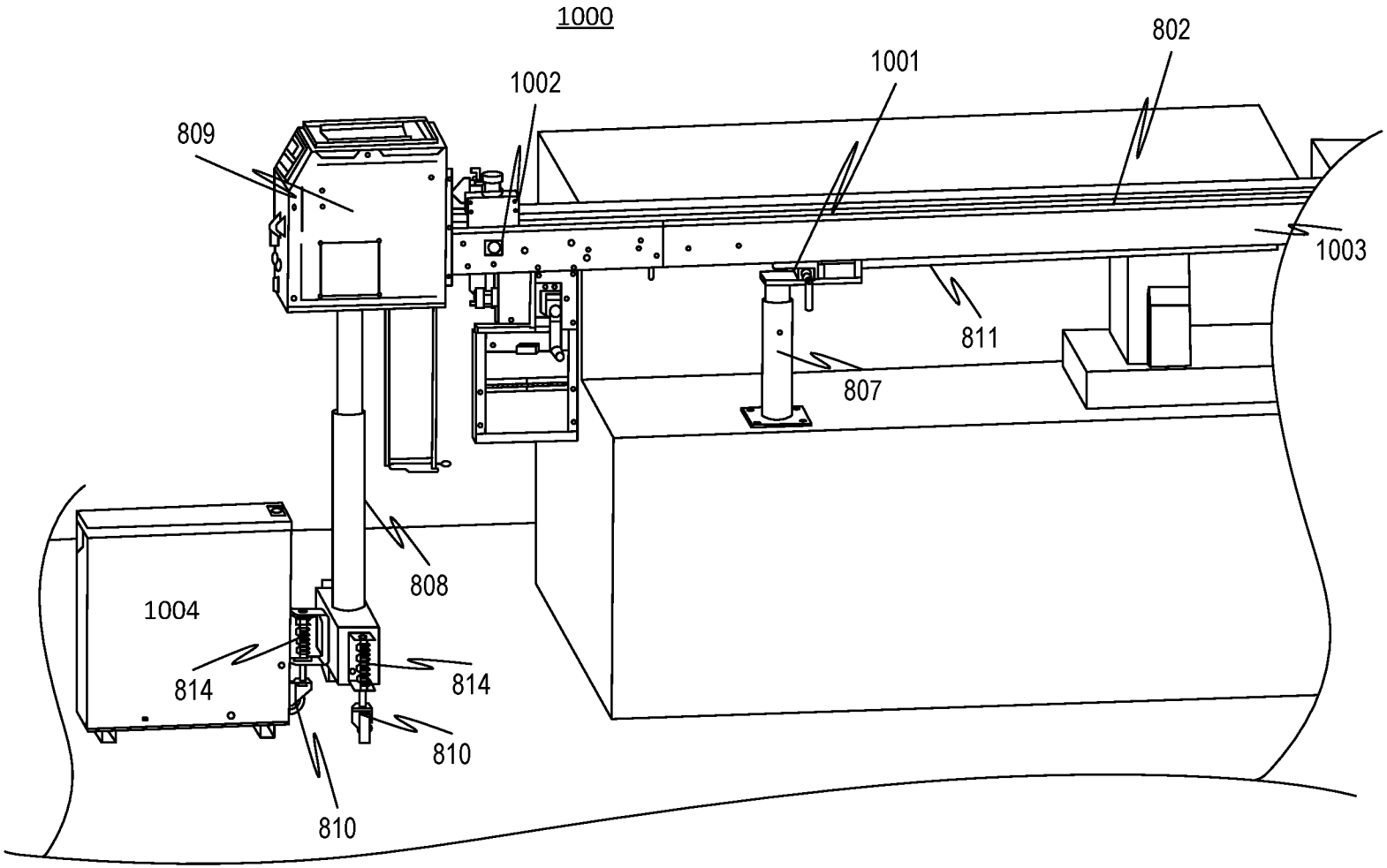

FIG. 10 illustrates a schematic diagram of an adjustable length transverse track and movable dispenser, in accordance with some embodiments of the present invention.

Figure 11:
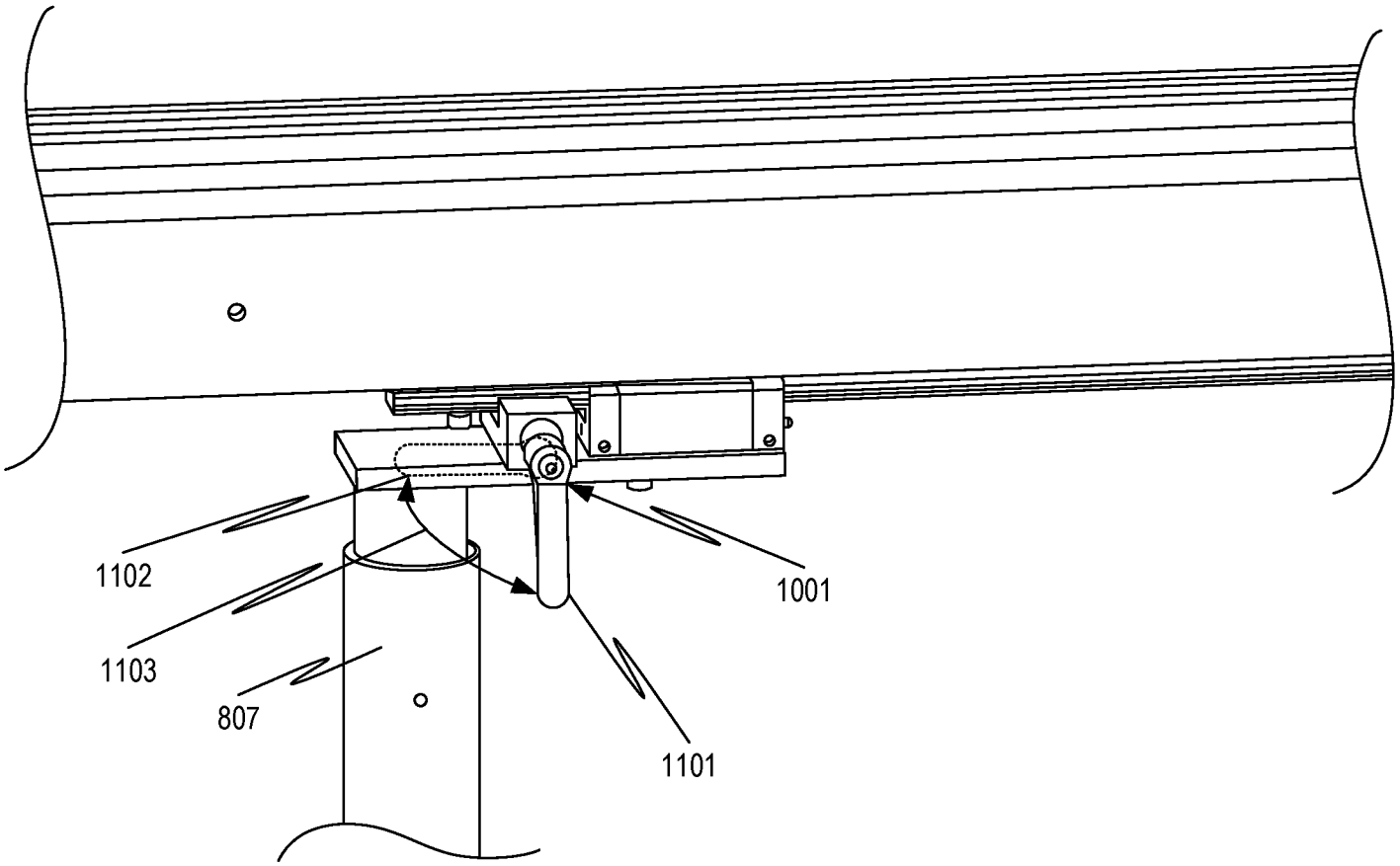

FIG. 11 illustrates a close up view of a transverse braking mechanism, in accordance with some embodiments of the present invention.

Figure 12:
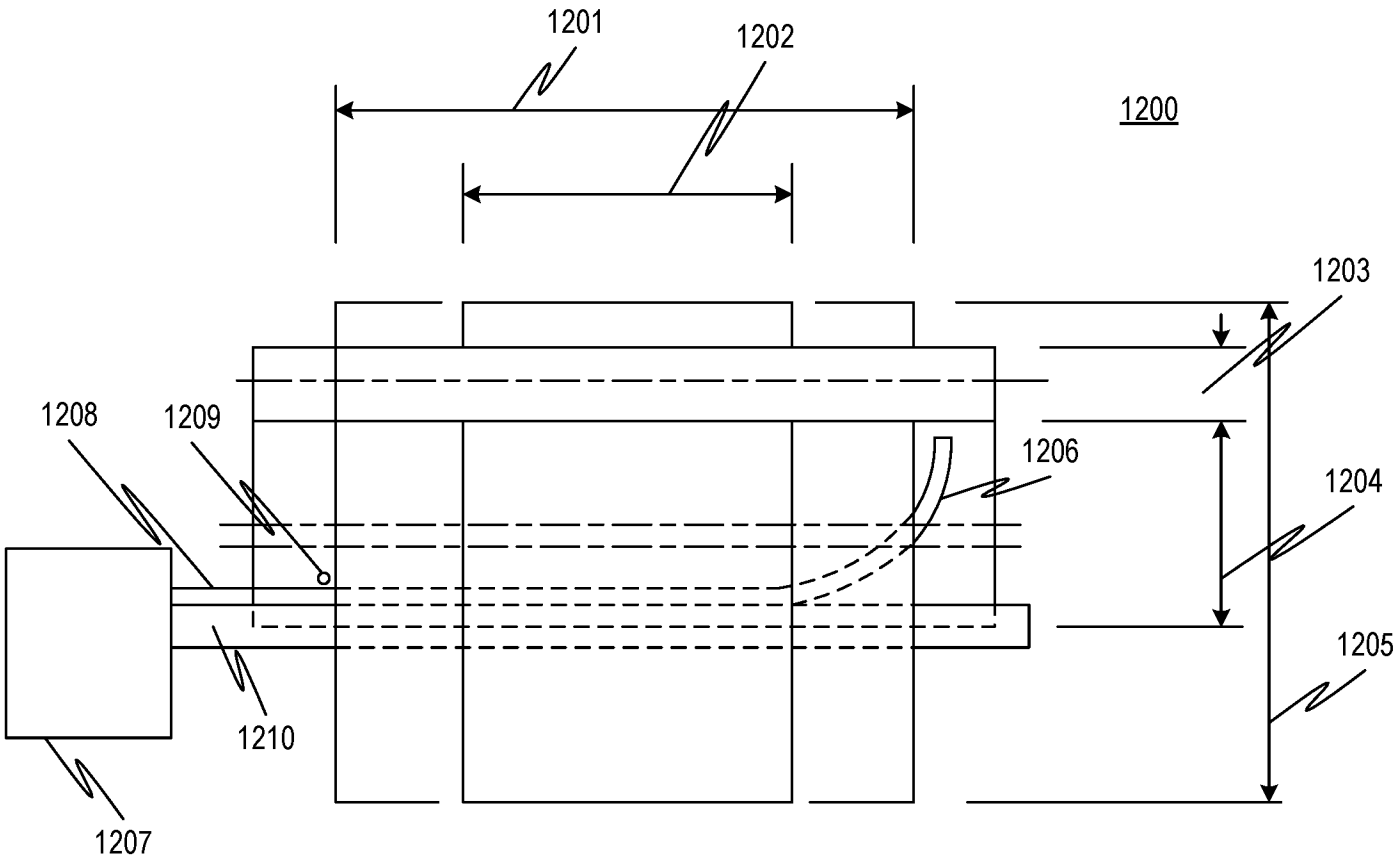

FIG. 12 illustrates an elevation view of a schematic diagram of an adjustable transverse track, in accordance with some embodiments of the present invention.

Figure 13:
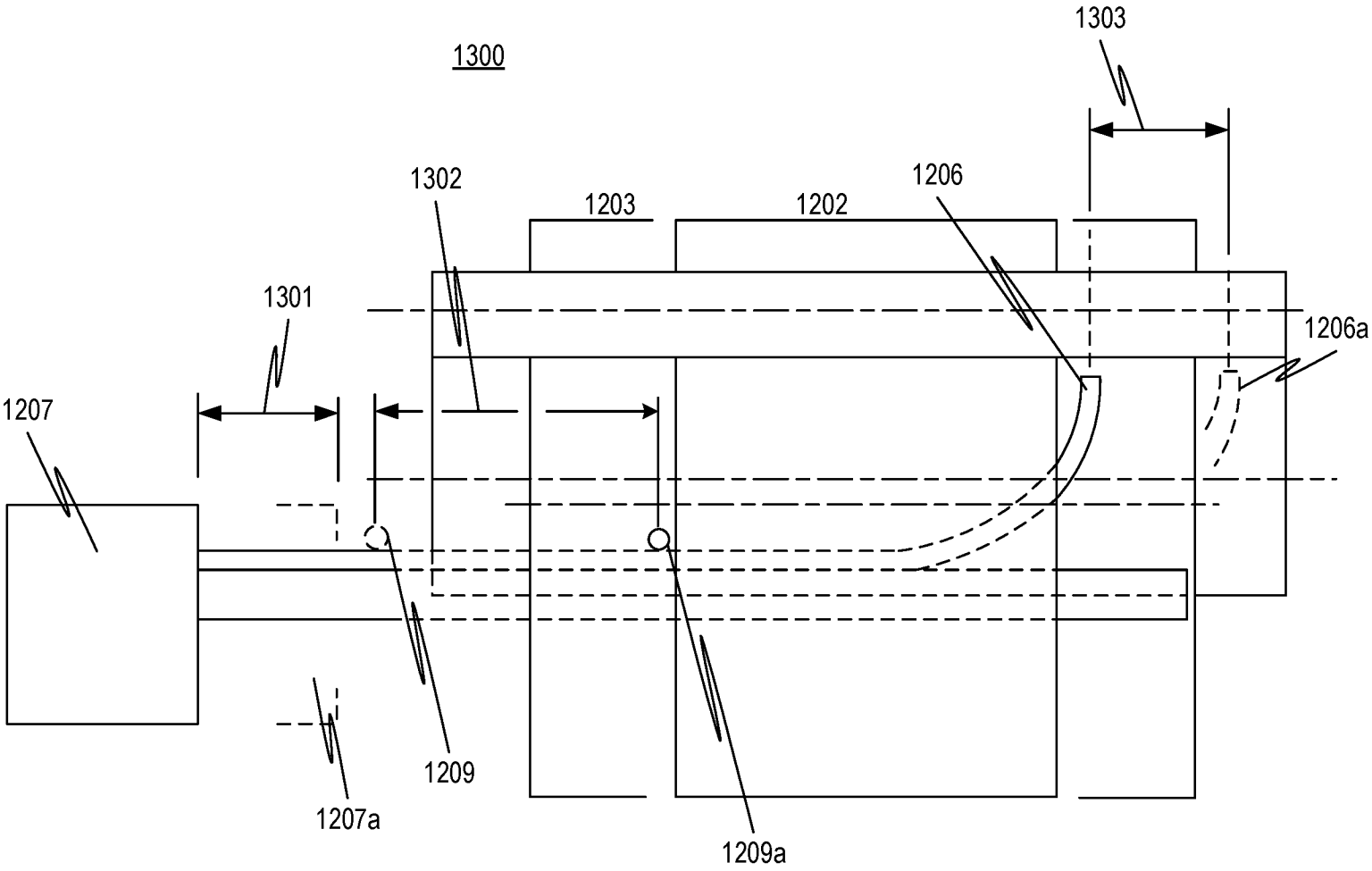

FIG. 13 illustrates an elevation view of a schematic diagram of an adjustable transverse track with a track curve at disparate positions, in accordance with some embodiments of the present invention.

Figure 14:
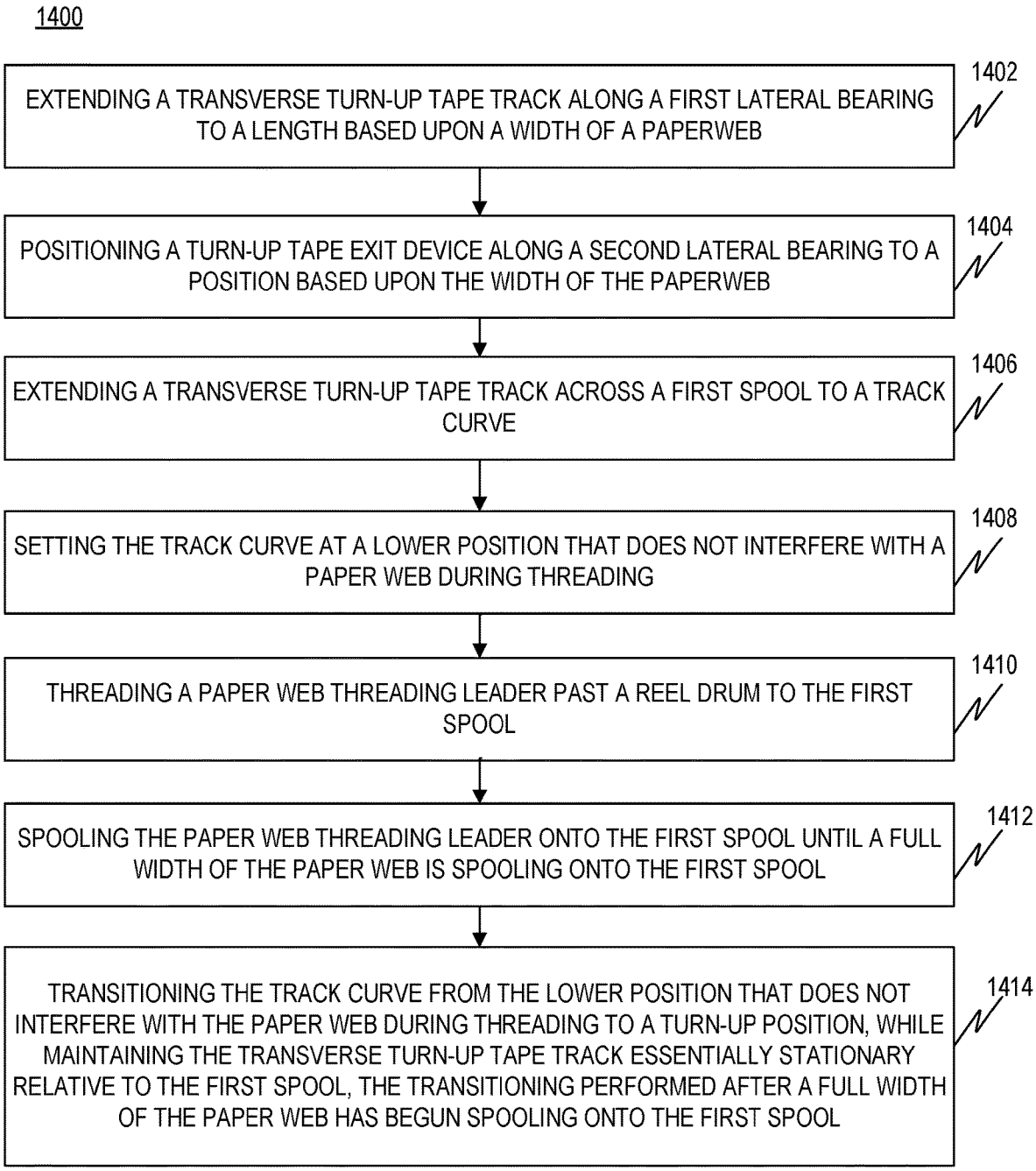

FIG. 14 illustrates a flowchart of method steps for implementing an adjustable track curve, in accordance with some embodiments of the present invention.

Figure 15:
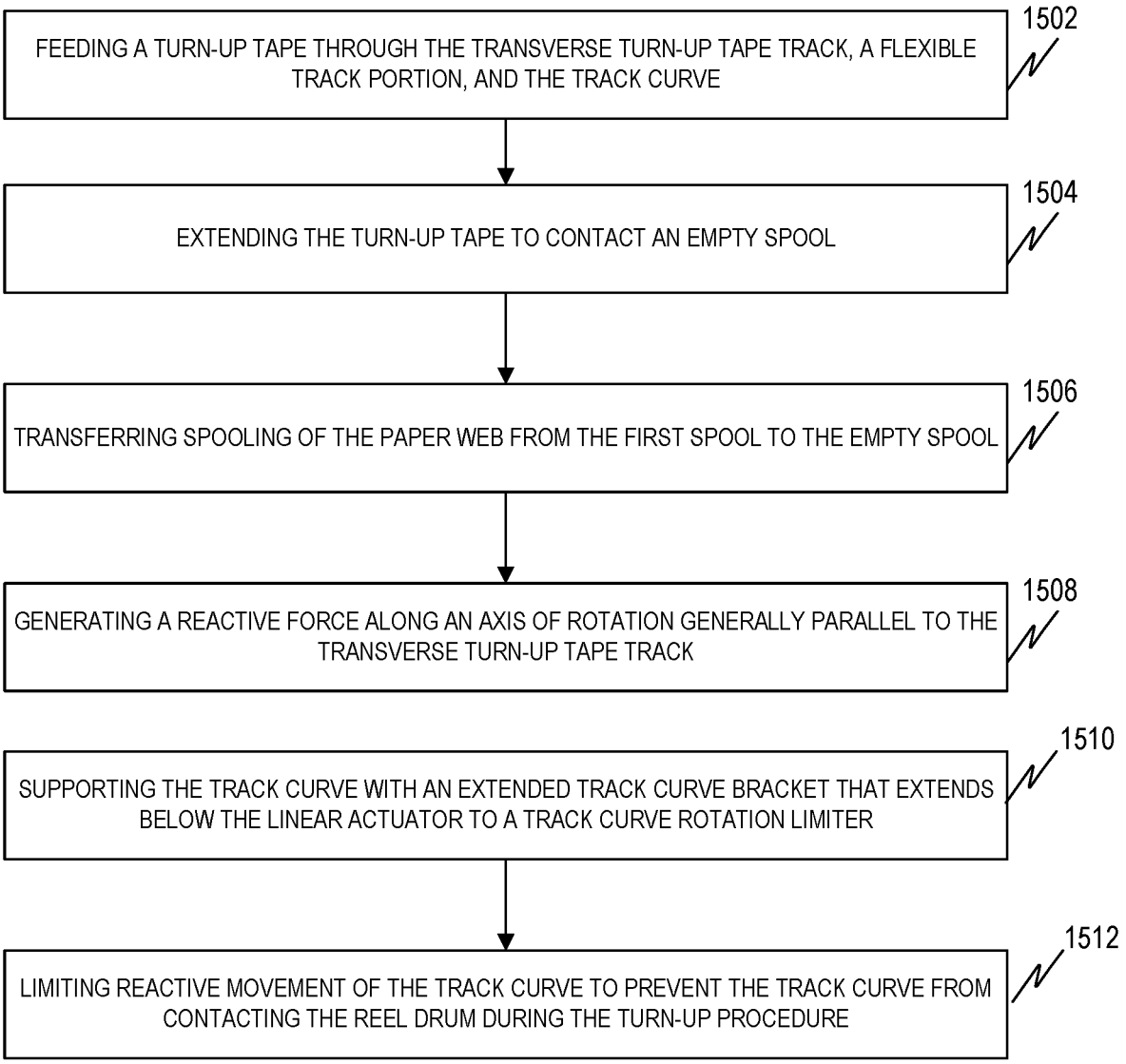

FIG. 15 illustrates a flowchart of method steps that may be executed for variable width turn-up procedures on a paper processing machine, in accordance with some embodiments of the present invention.

FIG. 16 illustrates a flowchart of additional method steps that may be executed for variable width turn-up procedures on a paper processing machine, in accordance with some embodiments of the present invention.

DETAILED DESCRIPTION OF DISCLOSURE

The present disclosure methods and apparatus for conducting turn-up procedures on a paper processing machine with paper webs of variable widths. In general, methods and apparatus are provided for enabling dynamic adjustment and placement of a turn-up tape on a paper processing machine, in order to bring about reliable and efficient turn-up processes on paper webs with one or both of variable widths and variable thicknesses. More specifically, the methods and apparatuses disclosed herein address problems associated with processing fiber webs with variable widths and/or variable thicknesses by enabling efficient and convenient repositioning of one or both of the exit point and the track curve feeding a turn-up band to accommodate disparate web width and/or thickness.

Adjustment of one or both of: a track curve position, and an exit point position of a turn-up tape is accomplished without disturbing other assemblies included in a paper processing machine by mounting the transverse track on linear bearings or bushings. A brake is provided to hold the transverse track assembly in the desired position. The turn-up system dispenser is mounted to the transverse track and moves with it.

Stress applied by a mass of a dispenser unit on a transverse track assembly and linear bearings may be compensated for via supporting the dispenser on casters, which may include adjustable spring-supported casters.

Further, the present disclosure describes apparatus and methods for conducting paper web turn-up operations. The processes facilitate a turn-up operation wherein a continuous paper web being rolled onto a first web spool is severed and transferred to an empty second web spool, such as, for example when the first web spool is fully wound. In the operation, a paper web turn-up operation and turn-up transfer may occur without requiring a flow of a paper web being processed to be significantly altered or stopped.

Further, the present disclosure describes apparatus and methods for dynamic adjustment of a position of a turn-up tape thereby enabling reliable and efficient turn-up processes on paper webs of variable widths and thicknesses. The methods and improved apparatus address problems associated with processing paper webs with variable widths and/or variable thicknesses by enabling efficient and convenient repositioning of an exit point of a track curve to accommodate disparate paper web widths or thicknesses.

In some embodiments, an adjustment may be made to one or both of a position of a track curve; and a placement of an exit point; in order to properly accommodate paper webs with a different width and/or a different thickness.

Further, in some embodiments, the methods and apparatus describe the fine adjustment of one or both of a turn-up tape's track curve position and a turn-up tape's exit point position.

Still further, in some embodiments, the present disclosure describes mounting a transverse tape track on linear bearings. A brake is provided to hold the transverse track assembly in a desired position. The turn-up system dispenser is mounted to the transverse track and moves with it. Stress applied by a weight of the dispenser unit on a corresponding transverse track assembly and linear bearings is compensated for by supporting the dispenser on adjustable spring-supported casters.

In various embodiments, a turn-up system dispenser may be placed on a same side, or on an opposite side of a paper processing machine as moving elements of the paper processing machine, such as, for example, ropes or conveyors used in a Paper Web production operation. The present disclosure describes methods and apparatuses for moving a curved portion of a Transfer Tape Track to a position that is clear of the plane of the Paper Web while threading the Paper Web and returning the curved portion to an operational position after threading the Paper Web and prior to performance of a Turn-up Procedure.

Further, various paper processing machines have components that vary in multiple respects; therefore, the present invention provides a paperband-based turn-up system that may be modified according to parameters of a particular paper processing apparatus. For example, the description of the mounting hardware may vary significantly, but the desired movement of the curve track and the forces to be managed in drive-side turn-up installations may generally be treated in a similar manner.

In general, the invention described includes methods and apparatus for improved turn-up procedures that may include a transverse turn-up tape track extended across a first spool suitable for receiving a paper web, and the transverse turn-up tape track sized to contain a turn-up tape. In some embodiments, the apparatus for improved turn-up procedures may also include a track curve movable from a lower position that does not interfere with a paper web during threading of the paper web for attachment of the paper web, to a turn-up position placing the turn-up tape in position to attach to a second spool during a turn-up procedure. A flexible track portion may be located between a transverse turn-up tape track and a track curve. A flexible track portion may be movable from a first position to a second position, or otherwise adjustable, to move the track curve from a lower position to a turn-up position (or other position), while the transverse turn-up tape track remains essentially stationary relative to the first spool. Essentially stationary may include minor movement of less than 10 centimeters, or other amounts that will not interrupt a turn-up procedure or other procedure that requires a turn-up tape within the track curve to be positioned with a range of positions.

Implementations may include one or more apparatus with: a track curve that is movable from the lower position to the turn-up position after threading a paper web threading leader to the second spool and widening the paper web threading leader; a setback device positioned to prevent the track curve from contacting a reel drum during track curve movement; a track curve bracket holding the track curve in position; a carriage attached to the track curve bracket; and a linear actuator operational to provide linear movement to the carriage and the track curve bracket, the linear movement being sufficient to move the carriage and the track curve bracket between the lower position and the turn-up position while the transverse turn-up tape track remains stationary relative to the first spool; a propulsion mechanism to move the linear actuator; a linear bushing or bearing contacting the track curve bracket to guide the movement of the track curve from the lower position to the turn-up position; an external stop to limit the downward vertical movement of the carriage; a track curve bracket extension positioned along a transverse track support and in contact with a track curve rotation limiter; a track curve rotation limiter may include a horizontal bar; and a track curve rotation limiter that limits reactive movement of the track curve along an axis of rotation parallel to the transverse turn-up tape track.

Further, the present disclosure methods and apparatus for improved web threading accommodation by a paperband turn-up system.

Glossary

Composite: as used herein a Composite means an item made up of distinct parts or elements.

Empty Spool: as used herein an Empty Spool (sometimes referred to as an Empty Reel, a New Spool, a Reel Spool, Web Spool, or an Empty Spool), means a Spool with a Spool Face essentially devoid of Paper Web. The Spool Face is suitable for a Paperband Composite to be wound around, and removably attached thereto. The Spool Face of an Empty Spool is commonly used to adhere a Transfer Tape upon and receive Paper Web transferred from being accumulated onto a Full Spool.

Exit Point: as used herein, an Exit Point refers to a position on a Transverse Turn-up Tape Track at which a paperband ceases being laterally pulled from the Transverse Turn-up Tape Track.

Exit Point Device: as used herein, an Exit Point Device refers to a mechanical or electromechanical device that causes a paperband to cease being laterally pulled from a Transverse Turn-up Tape Track at the Exit Point.

Full Spool: as used herein a Full Spool (which may sometimes be referred to as an Old Spool, a Parent Web Spool, Full Web Roll, and/or a Full Roll), refers to a Web Spool that is substantially nearing its capacity for holding Paper. Nip: as used here Nip refers to the area where a paper web or sheet is pressed between two rolls/spools.

Paperband: as used herein, a Paperband (sometimes referred to as a Turn-up Tape, Transfer Tape, or Paper Band), refers to a substrate adapted for extending across a longitudinal cylindrical surface of one or both of an Empty Spool and a paper bearing Web Spool. A Paperband may include multiple layers.

Paperband Composite: as used herein means a Paperband with a first side and a second side, the first side having at least one layer of adhesive. A Paperband Composite may include multiple distinct elements and/or parts.

Paper Web: as used herein refers to a newly formed continuum of paper that is processed and rolled on a paper machine.

Parent Web Roll: as used herein a Parent Web Roll, which may be called an Old Spool or a Full Spool, refers to a web spool that is substantially nearing its capacity for holding paper web.

Reel Drum: as used herein a Reel Drum refers to a spool used to drive movement of a paper web; in some embodiments, a Reel Drum may impart rotational movement to a Parent Roll receiving a paper web in a reeling action.

Transfer Tape: as used herein a Transfer Tape (sometimes referred to as a turn-up tape, or Paper Band), refers to a substrate adapted for extending across a longitudinal cylindrical surface of one or both of an empty web spool and a paper bearing web spool. The Transfer Tape may include multiple layers.

Transfer Tape Track: as used herein means an apparatus for containing a Transfer Tape while the Transfer Tape is extended laterally across a paper machine prior to a Turn-Up procedure.

Turn-Up: as used herein, a Turn-Up means a process involving switching a paper web from a nearly completed parent web spool to an empty web spool. A Turn-up process may include severing a paper web from a rotating parent web roll nearing its capacity to hold paper, transferring the paper web to an empty web spool, and securing the paper web to the empty web spool.

Web Spool: as used herein a Web Spool means a metal roll onto which a web, such as, for example a Paper Web, is wound during a reeling operation. A Web Spool may also be referred to as a Reel Spool. A Web Spool may include an Empty Spool, a Full Spool, and/or Parent Roll.

Figure 1:
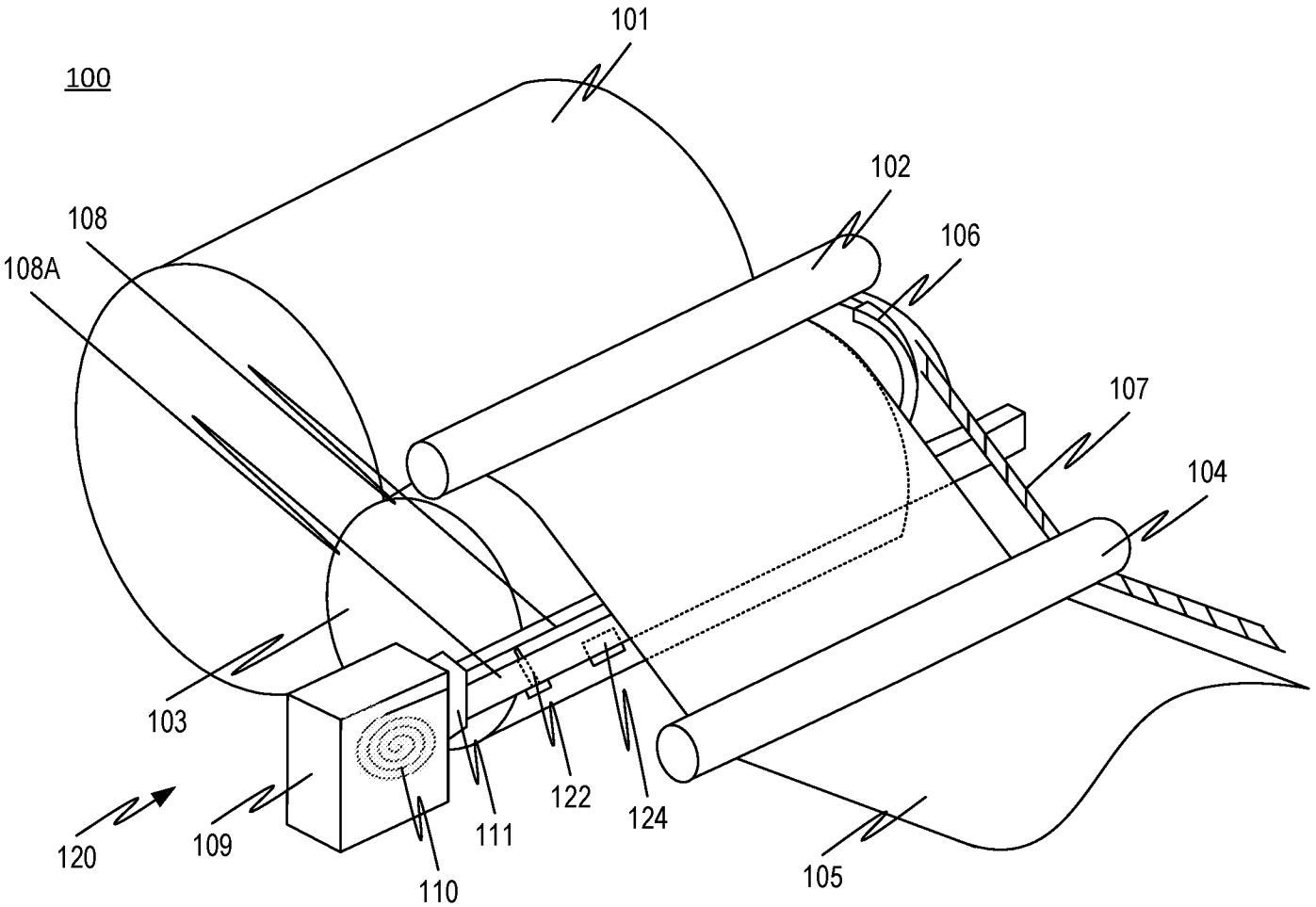
FIG. 1 illustrates a top perspective view of an exemplary apparatus with a Parent Roll, an Empty Spool and a Paper Web with a Turn-up Dispenser, in accordance with some embodiments of the present invention.

Referring now to FIG. 1, a schematic diagram illustrates an Apparatus 120 for facilitating variable width turn-up procedures on a Paper Processing Machine 100, an improved Paper Web turn-up operation enables a continuous Paper Web being rolled onto a first Web Spool to be severed and transferred to a Second Spool, e.g., an Empty Spool. Typically, the transfer of the Paper Web from a first Web Spool to the second Web Spool is performed as the first Web Spool approaches being fully wound. The transfer occurs without requiring a flow of the Paper Web to be significantly altered or stopped.

An Empty Spool 102 is positioned to take up the Paper Web 105 during a Turn-up Procedure during which the Paper Web 105 is transferred from being wound around the Full Spool 101, to being wound around the Empty Spool 102. A Turn-up Tape 110 is coiled in a Turn-up Tape Dispenser 109. A Feed Actuator 111, or other manual or automated feeding device, may feed the Turn-up Tape 110 through a Transverse Paperband Track 108 and into a Track Curve 106. The Track Curve 106 needs to be kept clear of one or more Threading Ropes 107 that may run along a length of the Paper Web 105. The Paper Web 105 may be guided by a Lead-in Roll 104. The Paper Web 105 may be run over a top of a Reel Drum 103 and into a nip between the Reel Drum 103 and the Full Spool 101 (which is named a full spool for the discussion of this invention but may begin in a state without any paper web spooled onto it) onto which the Paper Web 105 will be wound. The Paper Web 105 may be attached to the Full Spool 101 and the Paper Web 105 may be spooled onto the Full Spool 101 eventually progressing from a Paper Web Threading Leader 303 to a full width of Paper Web 105 being spooled. After the full width of Paper Web 105 has begun being spooled on the Full Spool 101, the Track Curve 106 position may be transitioned to a turn-up position.

As illustrated, a Full Spool 101 may be positioned proximate to an Empty Spool 102 such that the Full Spool 101 and the Empty Spool 102 have respective surfaces that are essentially parallel to each other in relation to a Paper Web 105 being threaded under a Lead In Roll 104 and over a Reel Drum 103 with a Curved Track Portion 106 adjacent to one or more Threading Ropes 107.

During a turn-up process, the Track Curve 106 may be placed in a first position. At a time during which a Paper Web 105 is being threaded onto an Empty Spool 102 (which eventually receives sufficient paper web to become a Full Spool 101) the Track Curve 106 may be positioned in a second position to avoid interference with transversely threading of the Paper Web 105 onto an Empty Spool 102. In some preferred embodiments, a change from the first position to the second position may be accomplished by flexing a Flexible Track Portion 112.

In some exemplary procedures, an operator of a Paper Making Machine 100 with an associated Turn-up Tape Dispensing Apparatus 109 may begin with initiation of a load cycle by closing a load switch or other actuator that controls conveyance of a Turn-up Tape 110 through a Turn-up Tape Track 108. The Paper Making Machine 100 produces a Paper Web 105 that is threaded onto a Full Spool 101.

At a point in time prior to a time that the Full Spool 101 becomes filled to capacity with Paper Web 105, the Turn-up Tape Dispenser 109 will be prepared for a Turn-Up Procedure, which includes proper placement of a Turn-up Tape 110 in a Turn-up Tape Dispenser 109 and loading into the Transverse Turn-up Tape Track and a Track Curve 106. A feed of the Turn-up Tape 110 may be initiated prior to a Turn-up Process. In some embodiments, controls for feeding the Turn-up Tape 110 may be integrated with other control systems on the other portions of the Paper Making Machine 100. Thus, initiation may be integral with the operation of the Paper Making Machine 100, or may occur in response to an operator action of a control specific to loading the Turn-up Tape 110, such as, for example, actuating a switch or pressing a button.

A Feed Actuator 111 may cycle to advance the Turn-up Tape 110 through the Transverse Paperband Track 108 to the Track Curve 106 into a position for attaching to an Empty Spool 102. The Feed Actuator 111 may have a programmed amount of stroke to move the Turn-up Tape 110, which may depend on aspects of the Paper Making Machine 100 such as, for example, the Paper Making Machine's 100 width, Paper Web 105 speed, diameter of a Spool 101-102 or Reel Drum diameter 103.

In some embodiments, a sensor may be used to detect an end of stroke of a piston deploying the Turn-up Tape 110, following which a Turn-up Process may occur. After the Turn-up Process is completed, the Feed Actuator 111 may reset to prepare for a next turn-up operation.

The Improved Apparatus 120 may include a Transverse Paperband Track 108 mounted on a first linear bearing (bushing) and extended across a surface of a first spool (empty spool and/or full spool) suitable for receiving a Paper Web 105. Further, said Transverse Paperband Track 108 may be sized to contain a Turn-up Tape 110 and movable along the first linear bearing. Accordingly, the Apparatus 120 may include a Turn-up Tape Dispenser 109 fixedly attached to a proximal end of a Transverse Track (Transverse Paperband Track 108) and movable with the transverse track along the first linear bearing. Furthermore, the Apparatus 120 may include a Track Curve 106 attached to a distal end of the transverse track. Moreover, the Apparatus 120 may include a movable Turn-up Tape Exit Device 122 mounted to a second linear bearing (bushing). Further, said second linear bearing may be attached to the transverse track. Accordingly, the Apparatus 120 may include a Brake (Brake Assembly) 124 operable to secure the transverse track in a position relative to the surface of the first spool.

In some embodiments, the Track Curve 106 may be movable from a first transverse position relative to the surface of the first spool to a second transverse position relative to the first spool.

In some embodiments, the Track Curve 106 may be movable from a lower vertical position that does not interfere with the Paper Web 105 during threading of the Paper Web 105 for attachment of the Paper Web 105, to a turn-up position placing the Turn-up Tape 110 in a position to attach to a second spool (empty spool and/or full spool) during a turn-up procedure.

Figure 2:
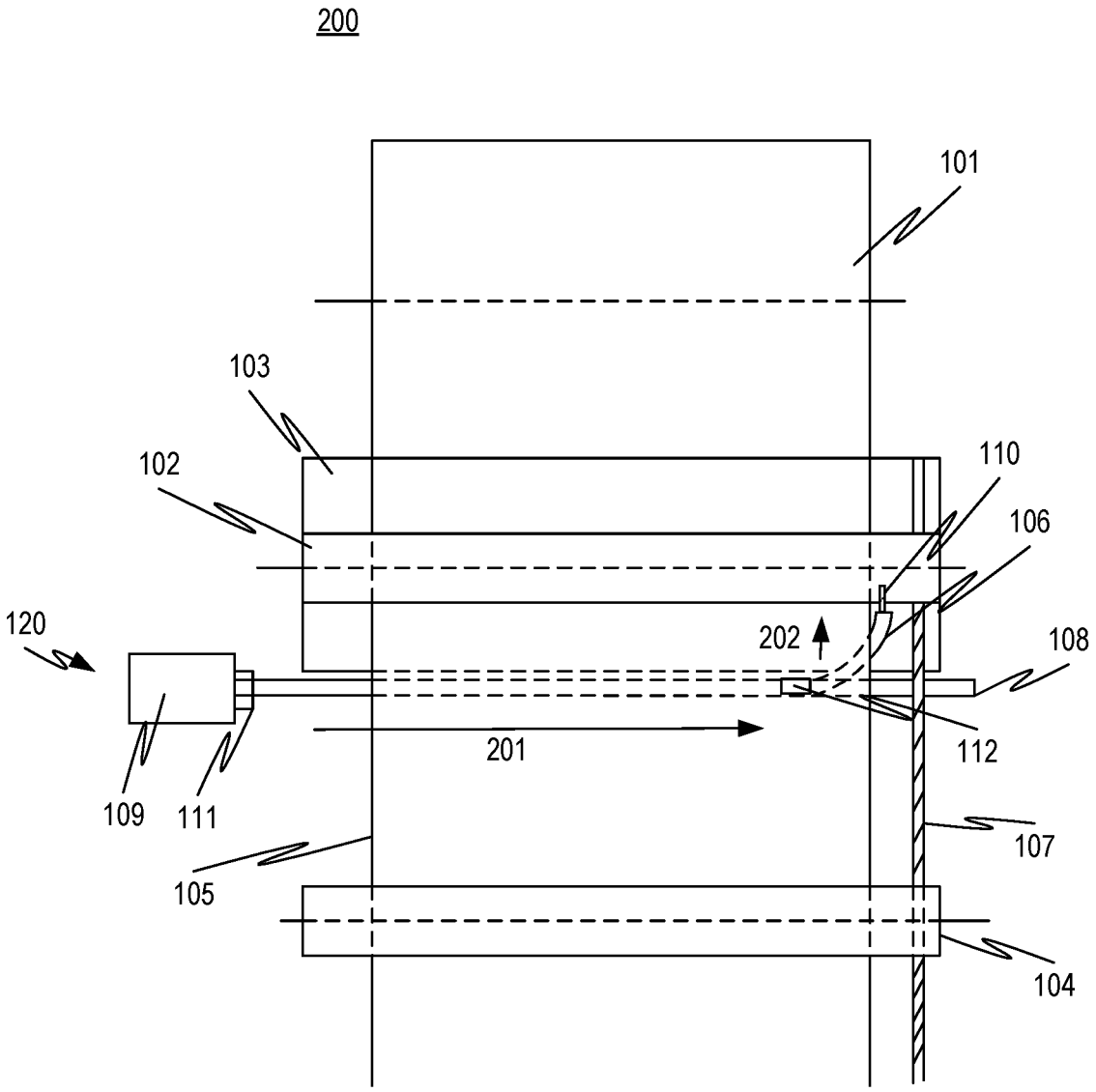
FIG. 2 illustrates a top view of top down view of a Parent Roll, an Empty Spool, and a Paper Web with a Turn-up Dispenser in accordance with some embodiments of the present invention.

In some embodiments, the Apparatus 120 may include a Flexible Track Portion 112, as shown in FIG. 2, between the Transverse Paperband Track 108 and the Track Curve 106. Further, the Flexible Track Portion 112 may be adjustable to move the Track Curve 106 from the lower position to the turn-up position, while the Transverse Paperband Track 108 remains essentially stationary relative to the first spool. In some embodiments, the Transverse Paperband Track 108 and the Flexible Track Portion 112, and the Track Curve 106 may be formed by a single piece of material, or multiple pieces of material. The single piece of material may be flexible in order to accommodate the various shapes included in the various pieces (108, 112, 106).

In some embodiments, the Apparatus 120 may include a Sensor 1002, as shown in FIG. 10, to detect a distance from a center of the first spool receiving the Paper Web 105 to an edge of the Paper Web 105. A paperband box 1004 may store paperband that is loaded into a paperband dispenser 809.

In some embodiments, the Apparatus 120 may be additionally comprising automation operative to ascertain whether the Track Curve 106 may be properly positioned for the turn-up procedure on the Paper Web 105 with the distance detected from the center of the first spool receiving the Paper Web 105 to the edge of the Paper Web 105.

Further, in some embodiments, the Paper Processing Machine 100 may be used for performing a paper turn-up process. Further, an Empty Spool 102 associated with the Paper Processing Machine 100 may be positioned to take up the Paper Web 105 during the turn-up procedure, during which the Paper Web 105 is transferred from being wound around a Full Spool 101 associated with the Paper Processing Machine 100, to being wound around the Empty Spool 102. Further, the Turn-up Tape 110 may be coiled in the Turn-up Tape Dispenser 109. Further, a Feed Actuator 111, or another manual or automated feeding device, may feed the Turn-up Tape 110 through the Transverse Paperband Track 108 and into the Track Curve 106. Further, the Track Curve 106 needs to be kept clear of one or more Threading Ropes 107 that may run along a length of the Paper Web 105. Further, the Paper Web 105 may be guided by a Lead-in Roll 104. The Paper Web 105 may be run over a top of a Reel Drum 103 and into a nip between the Reel Drum 103 and the Full Spool 101 (the Full Spool 101 may be associated with a state in which the Full Spool 101 may not have any paper web spooled onto the Full Spool 101) onto which the Paper Web 105 will be wound. The Paper Web 105 may be attached to the Full Spool 101 and the Paper Web 105 may be spooled onto the Full Spool 101 eventually progressing from a Threading Leader 303 (paper web threading leader) to a full width of Paper Web 105 being spooled. After the full width of Paper Web 105 has begun being spooled on the Full Spool 101, the position of the Track Curve 106 may be transitioned to a Turn-up Position (Turn-up Position 505*a*).

Further, the Full Spool 101 may be positioned proximate to the Empty Spool 102 such that the Full Spool 101 and the Empty Spool 102 have respective surfaces that are essentially parallel to each other in relation to the Paper Web 105 being threaded under the Lead-in Roll 104 and over the Reel Drum 103 with a Curved Track Portion 106 adjacent to one or more Threading Ropes 107.

During the paper turn-up process, the Track Curve 106 may be placed in a first position. At a time during which the Paper Web 105 is being threaded onto the Empty Spool 102 (which eventually receives sufficient paper web to become a Full Spool 101), the Track Curve 106 may be positioned in a second position to avoid interference with transverse threading of the Paper Web 105 onto the Empty Spool 102. In some preferred embodiments, a change from the first position to the second position may be accomplished by flexing the Flexible Track Portion 112.

In some exemplary procedures, an operator of the Paper Processing Machine 100 associated with the Turn-up Tape Dispenser 109 may begin with an initiation of a load cycle by closing a load switch or other actuators that control a conveyance of the Turn-up Tape 110 through the Transverse Paperband Track 108. Further, the Paper Processing Machine 100 produces the Paper Web 105 that may be threaded onto the Full Spool 101.

At a point in time prior to a time that the Full Spool 101 becomes filled to capacity with the Paper Web 105, the Turn-up Tape Dispenser 109 may be prepared for the turn-up procedure, which includes proper placement of a Paperband (Turn-up Tape 110) in the Turn-up Tape Dispenser 109 and loading into the Transverse Paperband Track 108 and the Track Curve 106. Further, a feed of the Turn-up Tape 110 may be initiated prior to the paper turn-up process. In some embodiments, controls for feeding the Turn-up Tape 110 may be integrated with other control systems on the other portions of the Paper Processing Machine 100. Thus, initiation may be integral to the operation of the Paper Processing Machine 100 or may occur in response to an operator's action of a control specific to loading the Turn-up Tape 110, such as, for example, actuating a switch or pressing a button.

Further, the Feed Actuator 111 may cycle to advance the Turn-up Tape 110 through the Transverse Paperband Track 108 to the Track Curve 106 into a position for attaching to the Empty Spool 102. Further, the Feed Actuator 111 may have a programmed amount of stroke to move the Turn-up Tape 110, which may depend on aspects of the Paper Processing Machine 100 such as, for example, the Paper Processing Machine's 100 Widths, Paper Web's 105 Speed, Spool's (101-102) Diameter, or Reel Drum's (103) diameter.

Referring now to FIG. 2, a top down view 200 illustrates a Lead-in Roll 104 with a Paper Web 105 in mechanical communication with a Full Spool 101 and a Reel Drum 103. An Empty Spool 102 is positioned proximate to the Full Spool 101 such that the Empty Spool 102 may receive a Paper Web 105 transferred from being wound around the Full Spool 101 to being wound around the Empty Spool 102 via a Turn-up Procedure.

A Turn-up Dispenser is positioned to dispense Turn-up Tape 110 through a Transverse Paperband Track 108 that is transverse across the Paper Web 105. The Transverse Paperband Track 108 is connected to a Track Curve 106 that is positioned to guide the Turn-up Tape 110 from a Transverse Direction 201 to a Turn-up Direction 202 that will cause the Turn-up Tape 110 to come into contact with the Empty Spool 102 and perform a Turn-up Procedure. According to the present invention, the Track Curve 106 is movable from a first position to a second position. Movement from the first position to the second position may occur via flexing a Flexible Track Portion 112. The first position may generally interfere with transverse threading of the Paper Web 105, which may run under the Lead-in Roll 104, over the Transverse Paperband Track 108, over the Reel Drum 103, under the Empty Spool 102, and around the Full Spool 101. The ability to move to the second position provides for improved operation of the Paper Machine due to the placement of the Track Curve 106 in the second position removes the Track Curve 106 from interfering with threading of the Paper Web 105.

In the first position, the Track Curve 106 is in mechanical communication to receive the Turn-up Tape 110 from the Transverse Paperband Track 108 and guide the Turn-up Tape 110 to an exit of the Track Curve 106 sufficiently close to the Empty Spool 102 to successfully perform a Turn-up Procedure. Typically, while a Track Curve 106 is at a second position the Turn-up Tape 110 will not be guided to an exit from the Track Curve 106 that is suitable for a successful Turn-up Process.

Figure 3:
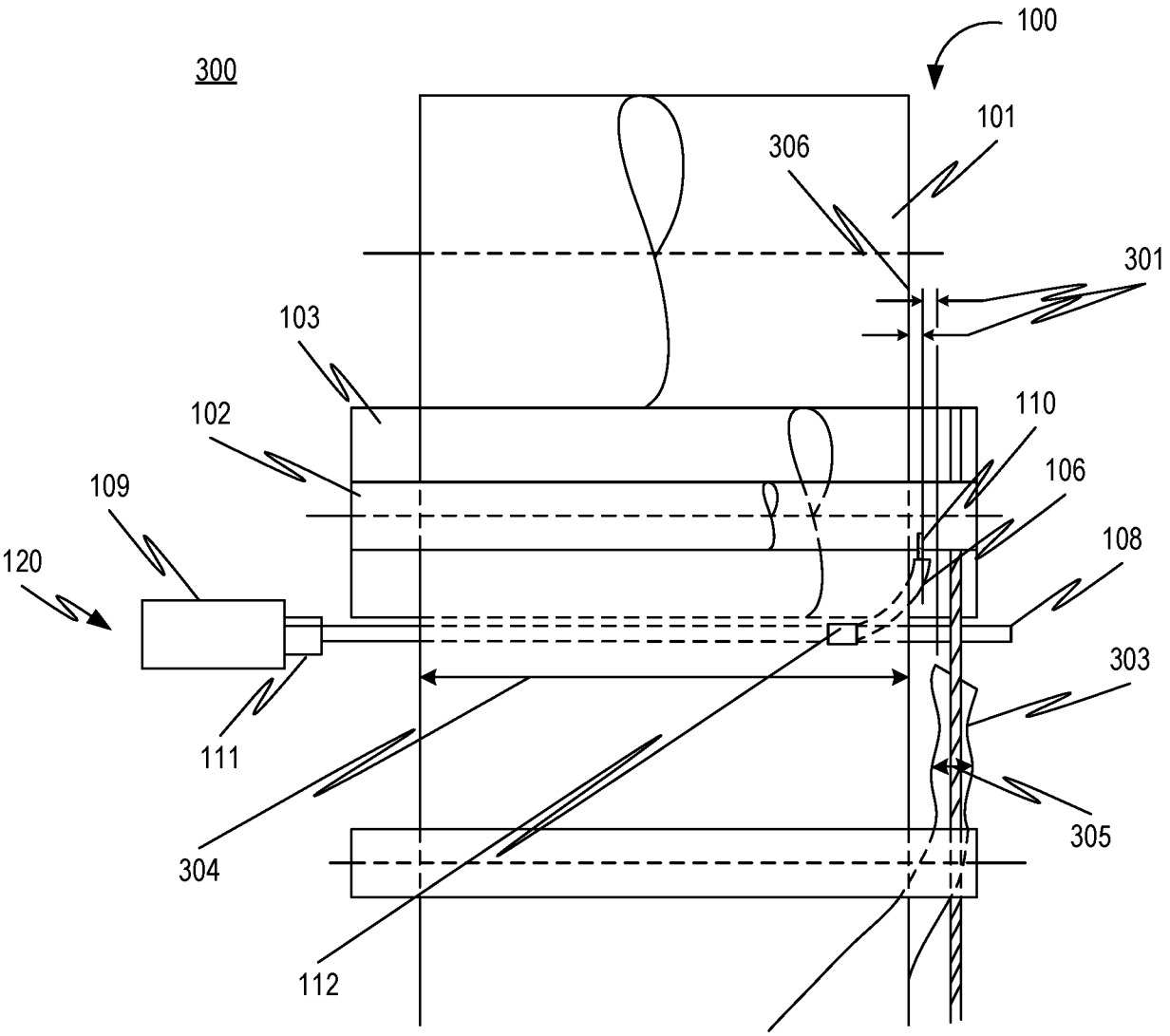
FIG. 3 illustrates a top view with a Threading Leader and Web width and position, in accordance with some embodiments of the present invention.

Referring now to FIG. 3, a Paper Making Apparatus 300 is illustrated with a Threading Leader 303. A Production Width 304 of a Paper Web 105 is shown in a Position 304 that is typical during Paper Web 105 production for comparison with a Threading Leader width 305 illustrated in an exemplary position during a threading of the Threading Leader 303. The Track Curve 106 in a first position is functional for conducting a Turn-up Procedure on a Paper Web 105 in a production width and position 305, however the Track Curve 106 in the first position occupies a Space 301 between the Threading Leader 303 and Trim 306 such that the Track Curve 106 is likely to interfere with threading of the Threading Leader 303. According to the present invention, the Track Curve 106 may be moved via a Flexible Track Portion 112 to a position that does not interfere with the threading of the Threading Leader 303. Typically, the threading of the Threading Leader 303 is to be completed before the Paper Making Apparatus 300 may proceed with normal Paper Web 105 reeling.

Figure 4:
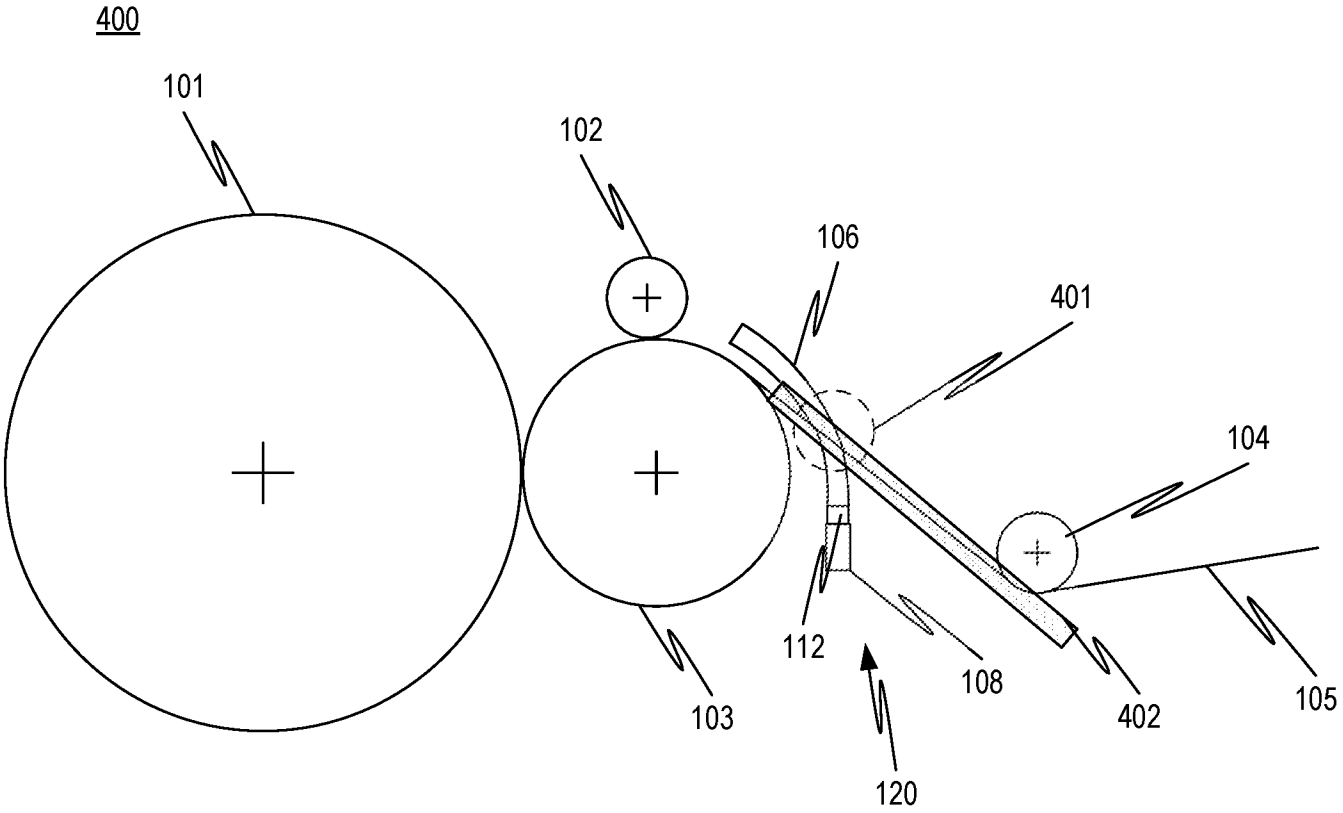
FIG. 4 illustrates an elevation view of a Paper Making Apparatus demonstrating a conflict of a Track Curve and a plane of a Paper Web and Threading Ropes, in accordance with some embodiments of the present invention.

FIG. 4 illustrates a side view of the Paper Processing Machine 100 with the Apparatus 120, in accordance with some embodiments. Further, the Paper Processing Machine (Paper Making Apparatus) 100 may include a Region of Interference 401 in which the Track Curve 106 is placed while the Track Curve 106 occupies a first position. Further, the Track Curve 106 occupying the first position conflicts with a Plane 402 of the Paper Web 105 as it is being threaded, and a position of the Threading Ropes 107. In order to proceed with normal paper web making processes, the Paper Web 105 is preferably threaded past the Transverse Paperband Track 108 and the Track Curve 106, over the Reel Drum 103, under the Empty Spool 102, to be wound on the Full Spool 101 (which begins in an empty state).

A Region of Interference 401 may create an obstacle to the threading while the Track Curve 106 is in the first position. The Track Curve 106 may be moved, such as for example, via flexing of the Flexible Track Portion 112, to avoid the Region of Interference 401.

Figure 5:
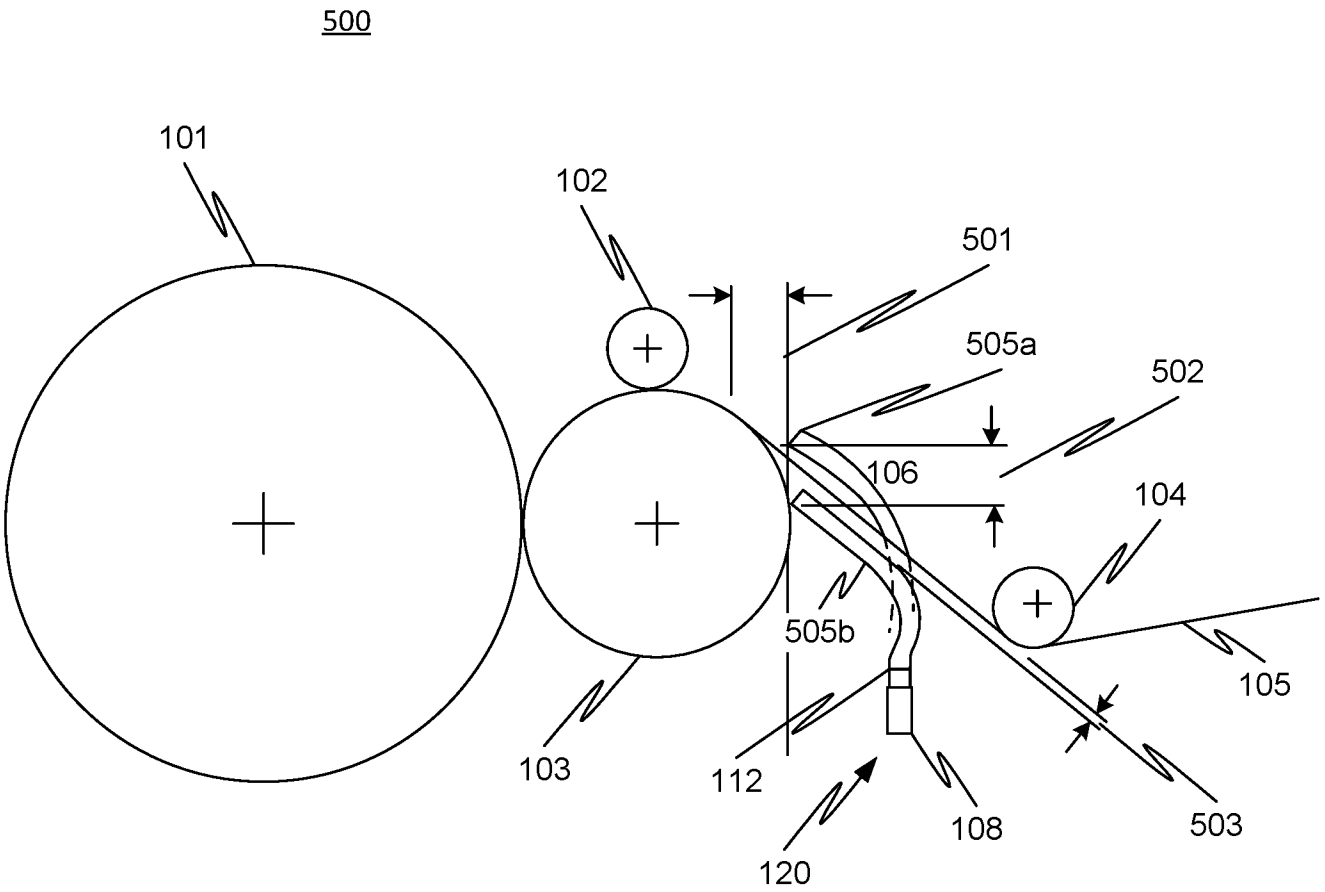
FIG. 5 illustrates an elevation view of a Paper Making Apparatus with a Track Curve that may be lowered beneath the plane of the Paper Web, in accordance with some embodiments of the present invention.
Figure 5A:
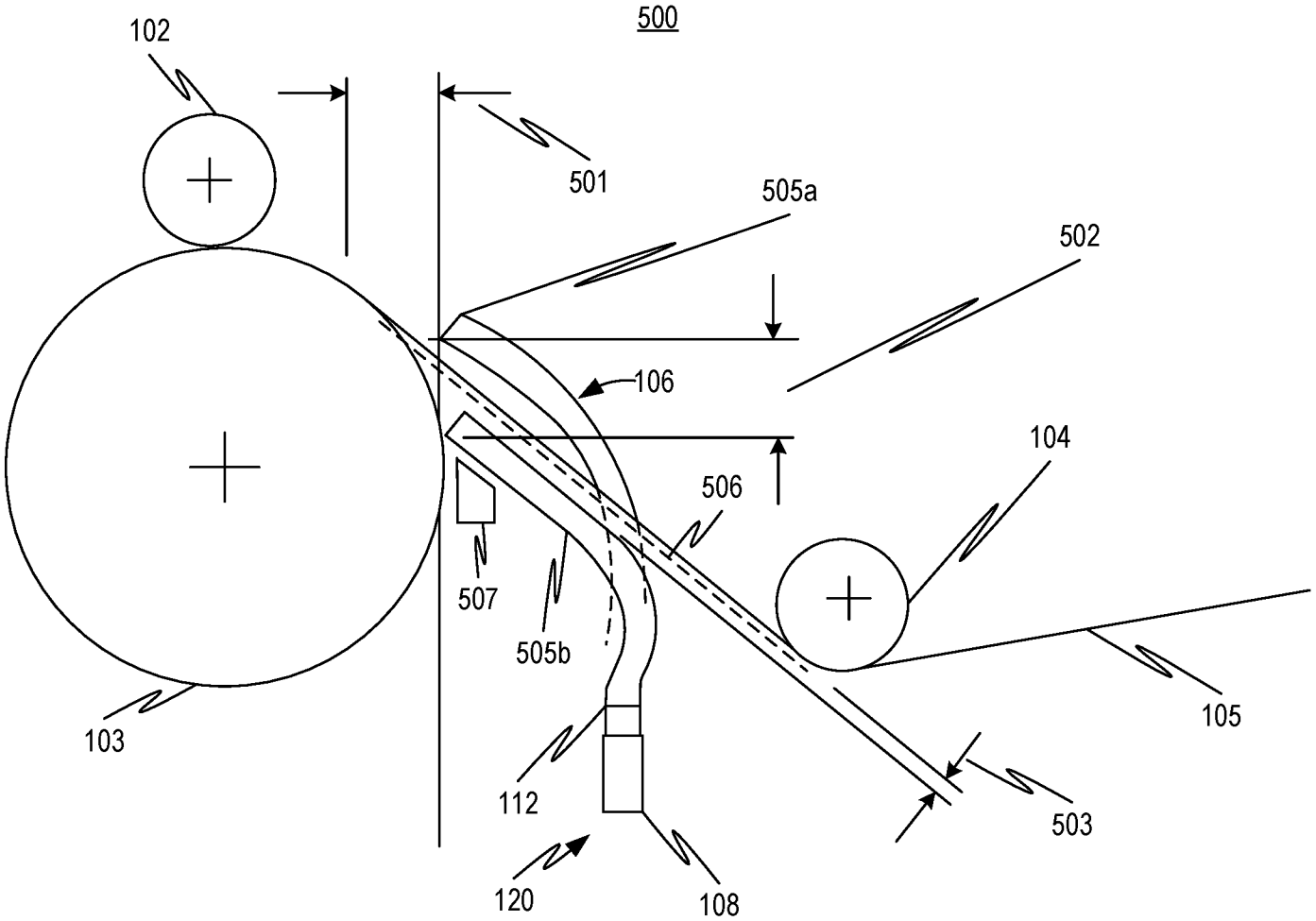
FIG. 5A illustrates a close up of a Track Curve that may be lowered beneath the plane of the Paper Web, in accordance with some embodiments of the present invention.

Referring now to FIG. 5 and FIG. 5A a schematic view (FIG. 5) and a blown up portion (FIG. 5A) of a Paper Making Apparatus 500 according to some embodiments of the present invention are illustrated with a Flexible Track Portion 112 of a Track Curve 106 that permits an operator, or an automation, to lower the Track Curve 106 to a position beneath a plane of a Paper Web 105 until a Required Clearance 503 is achieved between the Track Curve 106 and the Paper Web 105 (or portion thereof, such as a Threading Leader of the Paper Web 105) while the Paper Web 105 (or portion thereof, such as a Threading Leader) is being threaded through various components of the Paper Making Apparatus 500. In some preferred embodiments, a Required Clearance 503 may be measured from a Plane 506 occupied by the Paper Web 105.

As illustrated, the Flexible Track Portion 112 includes a flexible, bendable, hinged, or otherwise moveable portion of a continuum of track components, including, for example, one or both of: the Transverse Paperband Track 108 and the Track Curve 106. The Flexible Track Portion 504 enables a human operator and/or an automation to move the Track Curve 106 between a Turn-up Position 505*a* and a Lowered Position 505*b*.

While the Track Curve 106 is located at a Lowered Position 505*b*, a Required Clearance 503 is achieved between the Track Curve 106 and a path of the Paper Web 105 and/or a portion of the Paper Web 105 comprising a Threading Leader (not illustrated in FIG. 5). Movement of the Track Curve 106 between the Turn-up Position 505*a* and a Lowered Position 505*b* traverses a Vertical Movement Distance 502.

In some embodiments, a Setback Distance 501 may be maintained to prevent the Track Curve 106 from contacting the Reel Drum 103. The Setback Distance 501 may be maintained via a Movement Containing Device 507, such as, one or both of a mechanical device and an electromechanical device positioned to prevent excessive Vertical Movement 502. The Movement Containing Device 507 may include a stop, shim, solenoid, or item effective to limit movement of the Flexible Track Portion 112.

In some embodiments, the Flexible Track Portion 112 includes a flexible, bendable, hinged, or otherwise moveable portion of a continuum of track components, including, for example, one or both of the Transverse Paperband Track 108 and the Track Curve 106. Further, the Flexible Track Portion 112 enables a human operator and/or an automation system to move the Track Curve 106 between the Turn-up Position 505*a* and a Lowered Position 505*b*.

While the Track Curve 106 is located at the Lowered Position 505*b*, a Required Clearance 503 is achieved between the Track Curve 106 and a path of the Paper Web 105 and/or a portion of the Paper Web 105 comprising the Threading Leader 303. Further, the movement of the Track Curve 106 between the Turn-up Position 505*a* and the Lowered Position 505*b* traverses a Vertical Movement Distance 502.

In some embodiments, a Setback Distance 501 may be maintained to prevent the Track Curve 106 from contacting the Reel Drum 103. The Setback Distance 501 may be maintained via a Movement Containing Device 507, such as one or both of a mechanical device and an electromechanical device positioned to prevent an excess of the Vertical Movement Distance 502. In various embodiments, the Movement Containing Device 507 may include a stop, a shim, a solenoid, or an item effective to limit the movement of the Flexible Track Portion 112.

Referring now to FIG. 6, a schematic view of a Paperband-based Turn-up System 600 is illustrated in context with components of a Paper Making Machine. The Paperband-based Turn-up System 600 is shown in FIG. 6 with a Track Curve 106 in an upper ready position, which may be referred to as the Track Curve Turn-up Position 601. A Linear Actuator 606 is mounted to a Linear Support, which may include one or more of: a rail, a rack gear, a rod, a channel, or the like. A Carriage 605 is movable via operation of the Linear Actuator 606.

A Connector 604 is attachable to the Carriage 605 and a Track Curve Bracketry 614 fixedly or removably attached the Track Curve Bracket 602 thereby supporting the Track Curve 601. The Carriage 605 is movable along the Linear Actuator 606 via a Propulsion Mechanism 623 such as, by way of non-limiting example, one or more of: air or hydraulic cylinder, motor and lead screw, magnetic coupling, etc.) to which Track Curve Brackets 602 are attached to support the end of the Track Curve 106. Track Curve Brackets 602 may be used to orient the Track Curve 106 into a Track Curve Turn-up Position 601 that is suitable to direct the Turn-up Tape 110 into a nip between the Empty Spool 102 and the Reel Drum 103.

The Linear Actuator 606 may be retracted thereby lowering the Track Curve 106. In lowering the Track Curve 106, the Track Curve 106 may be removed from a position in which it interferes with a plane of the Paper Web 105, thus allowing a Threading Leader 305 (not illustrated in FIGS. 6-6B) to be widened without colliding with portions of the Turn-up Track, such as, for example, the Transverse Paperband Track 108, the Track Curve 106, and the Flexible Track Portion 504). Extending the Linear Actuator 606 raises the Track Curve 106, and positions Track Curve 106 in the Track Curve Turn-up Position which is suitable to perform a Turn-up Process.

Referring now to FIG. 6A, a schematic view of a Paperband-based Turn-up System 600 illustrates a Track Curve 106 placed in a Track Curve Lower Position 610. The Linear Actuator 606 and Track Curve Bracketry 602 are mounted to the Transverse Track Support in a vertical orientation. Limits of travel of the Track Curve 106 may be integral to the Linear Actuator 606. In some preferred embodiments, limits of travel of the Track Curve 106 may include adjustable external stops, or a combination of integral and external stops.

In another aspect, in some embodiments, a Track Curve 106 may be cut to a length that prevents a tip (or other end) of the Track Curve 106 from contacting the Reel Drum 103 while the Track Curve is in the Track Curve Lower Position 610 or other retracted position.

In some embodiments, the Linear Actuator 606 may extend to position the Track Curve 106 for a Turn-up Procedure. In some various embodiments, a tip of the Track Curve 106 may be farther from the nip than preferred in a traditional static installation, however, adjustments may be made to one or more of: an angle of the Turn-up Tape 110 to the Empty Spool 102; a length of Turn-up Tape 110 extended from the Track Curve 106, a stiffness of the Turn-up Tape 110, or other variable to accommodate a distance of the Track Curve 106 may be farther from the nip.

In some preferred embodiments, the Track Curve 106 may include at least a portion fashioned with a flexible material, such as an extrusion of a slippery polymer. A length and positioning of the Track Curve 106 may be coordinated to allow the Track Curve 106 to be collapsed without kinking or distorting such that the ribbon may be pushed through it easily after repeated cycles.

Referring now to FIG. 6B, a perspective schematic view of a Paperband-based Turn-up System 600 according to some embodiments of the present invention is illustrated with apparatus to control (including, in some embodiments, limiting) an amount of Reactive Movement 612 of the Track Curve 106. A force to cause Reactive Movement 612 may be initiated during a Turn-up Procedure as the Turn-up Tape 110 is drawn out of the Track Curve 106 after attaching to a rotating Empty Spool 102 (not shown in FIG. 6B).

In some embodiments, a Track Curve 106 may be supported by bracketry mounted to elements of the Paper Making Apparatus 600. For example, the Track Curve Bracketry 602 may be fixedly attached to the Track Curve 106 at a first point and fixedly attached to the Carriage of the Linear Actuator at a second point, enabling the Track Curve 106 supported at multiple points to accommodate an extension and/or retraction force on the Track Curve 106. A force for Reactive Movement of the Track Curve 106 may be generated, for example, during a Turn-up Procedure, or at any time that Turn-up Tape 110 is drawn from the Track Curve 106.

In some embodiments, dynamics of a Paperband-based Turn-up System 600 on a Paper Machine tend to pull the tip of the curve toward the nip, which it is preferable to prevent. Deflection of the Track Curve 106 and the Track Curve Bracketry 602 may be apparent when sighting along a length of the Transverse Paperband Track 108 if the deflection manifests as a twisting of the Transverse Paperband Track 108 and rotation of the Track Curve 106 toward the Reel Drum 103 and Empty Spool 102. Deflection may be reduced and/or prevented with an extended Track Curve Bracketry 614 that continues to a point extension below a longitudinal axis of the Transverse Paperband Track 108 and is secure at an anchor point that permits vertical travel while resisting rotation. Although the dynamics of a turn-up will tend to pull the Transverse Paperband Track 108 and the Track Curve 106 closer to the Reel Drum 103, this is sufficiently resisted by the Transverse Track Support and Horizontal Bars 615 or other bracing that support the Transverse Paperband Track 108 from a floor or paper making machine frame.

Various Paper Making Machines often have components that vary in different respects, therefore a Paperband-based Turn-up System 600 may be modified according to specifications of a particular Paper Making Machine. Accordingly, the description of the mounting hardware may vary significantly, but the desired movement of the curve track and the forces to be managed in drive-side turn-up installations may generally be treated in a similar manner.

A Track Curve 106 may be in an upper ready position, which may be referred to as a Turn-up Position 601 of the Track Curve 106. A Linear Actuator 606 may be mounted to a Linear Support 620, which may include one or more of a rail, a rack gear, a rod, a channel, or the like. A Carriage 605 may be movable via the operation of the Linear Actuator 606.

A Connector 604 may be attachable to the Carriage 605 and a Track Curve Bracketry 614 may be fixedly or removably attached to a Track Curve Bracket(s) 602 thereby supporting the Track Curve 106. The Track Curve Bracket 602 may be associated with a Linear Bushing 603. The Track Curve Bracket 602 may be associated with a Lower Guide 608. The Carriage 605 may be movable along the Linear Actuator 606 via a propulsion mechanism 623 such as, by way of non-limiting example, one or more of an air or hydraulic cylinder, a motor and lead screw, and a magnetic coupling, to which Track Curve Brackets 602 are attached to support the end of the Track Curve 106. The Track Curve Brackets 602 may be used to orient the Track Curve 106 into the Turn-up Position 601 which is suitable to direct the Turn-up Tape 110 into a nip between the Empty Spool 102 and the Reel Drum 103.

The Linear Actuator 606 may be retracted thereby lowering the Track Curve 106. In lowering the Track Curve 106, the Track Curve 106 may be removed from a position in which it interferes with a plane of the Paper Web 105, thus allowing the Threading Leader 303 to be widened without colliding with portions of a turn-up track, such as, for example, the Transverse Paperband Track 108, the Track Curve 106, and the Flexible Track Portion 112). Extending the Linear Actuator 606 raises the Track Curve 106, and positions the Track Curve 106 in the Turn-up Position 601 which is suitable to perform the paper turn-up process (turn-up process).

The Track Curve 106 may also be placed in a Lower Position 610 (lowered position). The Linear Actuator 606 and the Track Curve Bracket 602 are mounted to a transverse track support in a vertical orientation. Limits of travel of the Track Curve 106 may be integral to the Linear Actuator 606. In some preferred embodiments, limits of travel of the Track Curve 106 may include Adjustable External Stops 607 or a combination of Integral Stops 609 and External Stops 607. The Track Curve 106 may be associated with a Track Curve Movement 611 comprising a movement between the Turn-up Position 601 of the Track Curve 106 and the Lower Position 610 (lowered position) of the Track Curve 106.

A Track Curve Rotation Limiter (such as Horizontal Bars 615) may be positioned to limit a Reactive Movement 612 of the Track Curve 106 along an Axis 613 of rotation parallel to the Transverse Paperband Track 108. Leverage of Extended Bracketry 616 engaged in the Horizontal Bars 615 may be used to prevent rotation of the Transverse Paperband Track 108 and the Track Turve 106. A Turn-up Dispenser Mobile Support 617 may be positioned to support the Turn-up Tape Dispenser 109. A Turn-up Dispenser Mobile Support 617 may include a Mobility Enhancer 618 (such as a wheel or bearing) to facilitate ease of movement of the Turn-up Dispenser Mobile Support 617. The Transverse Track Curve 106 may be supported by a Transverse Track Support 619.

Referring now to FIG. 7, a schematic view 700 illustrates a Full Spool 701 in position relative to an Empty Spool 702 and a Reel Drum 704. A Track Curve 703 is positioned for a turn-up procedure on a Wide Web 708 that is routed in a Direction of Travel 710 under a Lead-in Roll 705 and over the Reel Drum 704. A dotted line representation of the Track Curve **703*a* illustrates a position of a Track Curve 703*a* more suitable for a turn-up procedure involving a Narrow Web 709**.

A Paperband Dispenser 707 is connected to a Transverse Track 706 and is operative to provide a paperband (or other turn-up tape medium) laterally across a width of the New Spool 702 and into the Track Curve 703.

Referring now to FIG. 8, a schematic diagram illustrates a Variable Width Turn-up Apparatus 800 that is capable of properly positioning a Paperband 812 (or other turn-up tape) for a turn-up process on a first paperweb of a first width, and a second paperweb of a second width. The first paperweb comprising a first width, may include, by way of non-limiting example, a Narrow Web 709, and a second paperweb comprising a second width, may include, by way of non-limiting example a Wide Web 708. The present invention allows for a position of a track curve to be adjusted so that a Variable Width Turn-up Apparatus 800 may be operative, and preferably most effective, for respective turn-up procedures on paperweb with respective different web widths.

In some embodiments, a Transverse Track 802 is supported via a Linear Track **804-804*a* secured to one or more Transverse Track Supports 807. The Linear Track 804-804*a* is movable in a linear fashion via one or more Linear Bearings 806. The Linear Bearing 806 may include a bushing, a roller bearing, or other device that provides for a smooth linear motion of the Linear Track 804-804*a*. A Securing Device 813 may be used to releasably secure the Linear Track 804-804*a* in the desired position. In some embodiments, the Transverse Track 802 and the Linear Track 804-804*a*** may be integrated into a single item. Integration may be accomplished via forming from a single material, or joining together of multiple disparate parts.

A Paperband (or other Turn-up Tape) Dispenser 809 is mounted to the Linear Track **804-804*a* and moves with the Linear Track 804-804*a* in a linear fashion. The weight of the Dispenser 809 may be supported with a Dispenser Support 808 to relieve stress on the Linear Track 804-804*a* and a first Linear Bearings 806 and a second liner bearing 806A (as described previously, a "linear bearing" may be referred to as a "linear bushing") the stress may result from unsupported weight on one end of the Linear Track 804-804*a*. Linear movement of the Dispenser 809, Dispenser Support 808, the Linear Track 804-804*a*, the Transverse Track 802** and the Track Curve 801, may be facilitated with a Mobility Enhancer 810, such as a caster, roller bearing, skid plate, or other mechanism reducing friction during movement of the Dispenser Support 808. Some preferred embodiments include an Adjustable Spring-support 814 mounting a caster as a Mobility Enhancer 810.

In some embodiments of the present invention, the Track Curve 801-801*a*, the Transverse Track 802 and supporting bracketry are mounted to the Linear Track 804 (rather than to reel section framework in traditional turn-up systems). With the Transverse Track 802 and Track Curve 801-801*a* are positioned at the edge of a narrow web, an Exit Point 803 may be mounted to an Exit Point Linear Bearing 815 (Exit Point Linear Bearing 815 may include a bushing, a roller bearing, or other device that provides for a smooth linear motion of the Exit Point 803 to a second position illustrated as 803*a*). The Exit Point Linear Track 805 may be mounted to the Transverse Track 802 and may be moved to an appropriate position 803*a* to properly perform a turn-up procedure on a paperweb of a particular width. In some embodiments, an exit point track may be at least twice as long as a necessary span of adjustment of the Track Curve 801 positions to accommodate desired paperweb widths. For example: assuming a width of a paperweb may change from eight (8) feet to four (4) feet and the paper web is preferably centered in the paper processing machine, then the track curve must move ½ of a difference in paperweb width, which, in the current example is two (2) feet. In preferred embodiments, the Exit Point 803 is mounted to the Transverse Track 802, moving the Transverse Track 8002 two (2) feet moves the Exit Point 803 two (2) feet away from an associated edge of the paperweb. Therefore, in this example, the Exit Point 803 preferably moves two (2) feet to regain its original position plus two (2) feet to an edge of the narrower web, for a total of four (4) feet versus the two (2) feet the Track Curve 801 will move.

Referring now to FIG. 9, a view of a papermaking apparatus 900 illustrates, an Exit Point 803 mounted independent of the Transverse Track 802 and Transverse Linear Track 811. As illustrated, the Exit Point 803 may be slidingly mounted on an Exit Point Track 901 and the Exit Point Track 901 may be bushing mounted to the Floor 902 via an Exit Point Support 903 independent of the Transverse Linear Track 811.

Embodiments with the Exit Point 803 mounted independent of the Transverse Track 802 and Transverse Linear Track 811 provides several advantages such as, by way of non-limiting example: enables shortening a required length of the Exit Point Track 901 and lengthening the Transverse Linear Track 811 by at least as much as the Exit Point Track 901 is shortened, and in some embodiments overlapping a linear distance comprising the length of travel of the Exit Point Track 901 and carriage 904 supporting the Exit Point 803, thereby enabling lengthening of the Transverse Linear Track 811 for a distance longer than the Exit Point Track 901. Shortening the Exit Point Track 901 is made possible by the separation of the movements of the Track Curve 801-801*a* and Exit Point 803. The Exit Point 803 and its Exit Point Track 901 are not required to move when the Transverse Track 802 and Track Curve 801-801*a* are moved. Consequently, the Exit Point 803 may be moved a same distance in the opposite direction as the Track Curve 801-801*a*, or any other movement conducive to processing a turn-up procedure on a particular web.

Embodiments with the Exit Point 803 mounted independent of the Transverse Track 802 and Transverse Linear Track 811 additionally enable an advantage in being able to mount the Transverse Track Supports 807 and associated bushings farther apart which may provide greater stability of the Variable Width Turn-up Apparatus 800.

Given adjustability of the Track Curve 801-801*a* is essentially independent of the Exit Point 803 Positions, in some embodiments the Track Curve 801-801*a*, and Exit Point 803 may be adjusted to accommodate an asymmetrical or off-center positioning of narrower webs as may be desirable to manage wear and tear of the Variable Width Turn-up Apparatus 800 and associated spools.

Referring now to FIG. 10, a Linear Track System 1000 is illustrated with a Linear Track Brake 1001 that is operational via user (or automation) interaction to secure the Linear Track Assembly 1003 in a set lateral position that holds the track curve (not shown in FIG. 10) stationary relative to a paperweb being processed.

As discussed, a Linear Track System 1000 may include one or both of a Transverse Track 802 and Linear Track 804-804*a*. The Transverse Track 802 and the Linear Track 804-804*a* may be disparate items or be integrated into a single item. Integration may be accomplished via forming from a single material, or joining together of multiple disparate parts.

The Track Brake 1001 may include a mechanical and/or electro-mechanical and/or electrical device that releasably secures the Transverse Track 802 and Track Curve 801-801*a* in a set position for a duration of a turn-up procedure. A Controller 809 may generate control signals that cause one or more automated components, such as, for example, the Dispenser 809, the Linear Track Brake 1001, or other component. The controller may include, a processor and digital storage storing executable software that is executable upon demand to generate the control signals and/or receive data providing a status of one or more items includes in the Linear Track System 1000.

Referring now to FIG. 11 a close up view of a Linear Track Brake 1001, in accordance with some embodiments is illustrated. The Linear Track Brake 1001 may have a Secure Position 1101 and a Release Position 1102. Brake Movement 1103 may transition the Linear Track Brake 1001 between the Secure Position 1101 and the Release Position 1102. A transition between the Secure Position 1101 and the Release Position 1102 may be generated by one or both of an operator and an automation (such as, for example, a solenoid, a servo motor, or other electromechanical device).

Referring now to FIG. 12, an elevation schematic view of a Variable Width Turn-up System 1200 is illustrated. The elevation view provides a spatial indication of how a Wide Web 1201 and the Narrow Web 1202 are positioned relative to: an Empty Spool 1203, a Reel Drum 1204, a Full Spool 1205, a Track Curve 1206 and a Paperband Dispenser 1207. The present invention provides that one or more of the Exit Point 1209, the Transverse Track 1208, and the Track Curve 1206 are laterally movable to accommodate Webs 1201-1202 of a disparate widths. In some embodiments, lateral movement may be facilitated with a Linear Track 1210. One or both of the Linear Track 1210 and the Transverse Track 1208 may be mounted on a configuration of bushings or bearings (not shown in FIG. 12) to guide and ease their lateral movement.

Referring now to FIG. 13, an elevation schematic view illustrates travel of components of a Turn-up System 1300 that may accommodate variable width webs, such as a Narrow Web 1202 and a Wide Web 1201. A Dispenser 1207 at a first dispenser location is illustrated with a Dispenser Travel Distance 1301 to a Second Dispenser Location 1207*a*. Similarly, an Exit Point 1209*a* is illustrated at a first exit point position with a Dispenser Travel Distance 1302 to a Second Exit Point Position 1209*a*. A Track Curve 1206 is illustrated at a first track curve position with a Track Curve Travel Distance 1303 to a Second Track Curve Position 1206*a*.

Referring now to FIG. 14, a Flowchart 1400 illustrates exemplary method steps that may be executed to accomplish a turn up procedure, in accordance with some embodiments of the present invention.

At Method Step 1402 the exemplary methods may include extending a transverse turn-up tape track along a first lateral bearing (or bushing type bearing) to a length based on a width of a paper web to be processed during a turn up procedure.

The Method 1400 may include a Step 1404 of positioning a turn-up tape exit device along a second lateral bearing to a position based on the width of the paper web.

The Method 1400 may additionally include the Step 1406 of extending a transverse turn-up tape track across a first spool to a track curve.

The Method 1400 may additionally include the Step 1408 of setting the track curve at a lower position that does not interfere with the paper web during threading.

The Method 1400 may additionally include the Step 1410 of threading a paper web threading leader past a reel drum to the first spool.

The Method 1400 may additionally include the Step 1412 of spooling the paper web threading leader onto the first spool until a full width of the paper web may be spooling onto the first spool.

The Method 1400 may additionally include the Step 1414 of transitioning the track curve from the lower position that does not interfere with the paper web during threading to a turn-up position, while maintaining the transverse turn-up tape track essentially stationary relative to the first spool. Also, the transitioning may be performed after the full width of the paper web may have begun spooling onto the first spool.

In some embodiments, the Method 1400 may include placing the paper web over a top of the reel drum and into a nip between the reel drum and the first spool.

In some embodiments, the Method 1400 may include supporting the track curve with a track curve bracket. The Method 1400 may include providing linear movement to the track curve bracket to move the track curve from a first position to the turn-up position.

In some embodiments, the Method 1400 may include operating a linear actuator to provide the linear movement of the track curve from the first position to the turn-up position.

In some embodiments, the Method 1400 may include guiding the linear movement of the track curve from the lower position to the turn-up position with a linear bushing.

FIG. 15 illustrates a flowchart for an Exemplary Method 1500 for performing turn-up procedures on a paper processing machine including generating a reactive force along an axis of rotation generally parallel to a transverse turn-up tape track, in accordance with some embodiments.

In some embodiments, the Method 1500 may additionally include a Step 1502 of feeding a turn-up tape through the transverse turn-up tape track, a flexible track portion, and the track curve. The Method 1500 may additionally include a Step 1504 of extending the turn-up tape to contact an empty spool. The Method 1500 may additionally include a Step 1506 of transferring spooling of the paper web from the first spool to the empty spool. Moreover, the Method 1500 may additionally include a Step 1508 of generating a reactive force along an axis of rotation generally may parallel to the transverse turn-up tape track.

The Method 1500 may include a Step 1510 of supporting the track curve with an extended track curve bracket that extends below the linear actuator to a track curve rotation limiter. Further, the Method 1500 may include a Step 1512 of limiting reactive movement of the track curve to prevent the track curve from contacting the reel drum during the turn-up procedure.

In some embodiments, the track curve rotation limiter may include a horizontal bar.

In some embodiments, the Method 1500 may include preventing, using a setback device, the track curve from contacting the reel drum during the linear movement of the track curve.

In some embodiments, the Method 1500 may include transitioning, following spooling of the paper web, the track curve from the turn-up position to the lower position that does not interfere with the paper web during threading, while maintaining the transverse turn-up tape track essentially stationary relative to the first spool.

Referring now to FIG. 16, a flowchart illustrates exemplary method steps that may be completed according to some embodiments of the present invention.

As shown in FIG. 16, Process 1600 may include supporting a transverse track having a proximal end and a distal end and capable of containing a paperband with a First Lateral Bearing (Block 1602). For example, device may support a transverse track having a proximal end and a distal end and capable of containing a paperband with a first lateral bearing, as described above. As also shown in FIG. 16, Process 1600 may include extending the distal end of transverse track across the lateral bearing to a first length based upon a width of a first paper web to be processed (Block 1604). For example, a distal end of transverse track may extend across the lateral bearing to a first length based upon a width of a first paper web to be processed, as described above.

Process 1600 may additionally include placing a track curve at the distal end of the transverse track in a first track curve position suitable to perform a turn-up procedure on the first paper web (Block 1606). For example, device may place a track curve at the distal end of the transverse track in a first track curve position suitable to perform a turn-up procedure on the first paper web, as described above. A first portion of paperband may be fed into the proximal end of the transverse track, through the transverse track, and into the track curve in a first track curve position (Block 1608).

For example, device may feed a first portion of paperband into the proximal end of the transverse track, through the transverse track, and into the track curve in a first track curve position, as described above. As further shown in FIG. 16, Process 1600 may include positioning a turn-up tape exit device along a second lateral bearing to a first exit point position based upon the width of the first paper web to be processed (Block 1610). For example, device may position a turn-up tape exit device along a second lateral bearing to a first exit point position based upon the width of the first paper web to be processed, as described above.

As also shown in FIG. 16, Process 1600 may include attaching the paperband to a location on a first empty spool suitable for performing a turn-up procedure on the first paper web to be processed (Block 1612). For example, device may attach the paperband to a location on a first empty spool suitable for performing a turn-up procedure on the first paper web to be processed, as described above.

The paperband may be exited from the transverse track at the first exit point position (Block 1614). For example, device may exit the paperband from the transverse track at the first exit point position, as described above.

As also shown in FIG. 16, Process 1600 may include performing a first turn-up procedure on the first paper web to be processed with the track curve in the first track curve position and the exit point at the first exit point position (Block 1616). For example, device may perform a first turn-up procedure on the first paper web to be processed with the track curve in the first track curve position and the exit point at the first exit point position, as described above.

In some embodiments, the distal end of transverse track may be extended across the lateral bearing to a second length based upon a width of a second paper web to be processed.

The exit point may be extended across the second lateral bearing to a second exit point position based upon the width of the second paper web to be processed.

The method may additionally include a step of placing the second paper web to be processed over a top of a reel drum and into a nip between the reel drum and a first spool.

Although the invention has been explained in relation to its preferred embodiment, it is to be understood that many other possible modifications and variations can be made without departing from the spirit and scope of the invention as hereinafter claimed.

It will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim limitation found herein and/or issuing here from that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present disclosure. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The detailed description refers to accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the claims found herein and/or issuing here from. The present disclosure contains headers. It should be understood that these headers are used as references and are not to be construed as limiting upon the subjected matter disclosed under the header.

The invention claimed is:

1. An apparatus for variable width turn-up procedures on a paper processing machine, the apparatus comprising:

a) a transverse turn-up tape track mounted on a first linear bearing and extended across a surface of a first spool for receiving a paper web, wherein said transverse turn-up tape track is sized to contain a turn-up tape and movable along the first linear bearing;

b) a turn-up tape dispenser fixedly attached to a proximal end of a transverse track and movable with the transverse track along the first linear bearing;

c) a track curve attached to a distal end of the transverse track;

d) a movable turn-up tape exit point mounted to a second linear bearing, wherein said second linear bearing is attached to the transverse track; and e) a brake operable to secure the transverse track in a position relative to the surface of the first spool.

2. The apparatus of claim 1, wherein the track curve is movable from a first transverse position relative to the surface of the first spool to a second transverse position relative to the first spool.

3. The apparatus of claim 1, wherein the track curve is movable from a lower vertical position that does not interfere with the paper web during threading of the paper web for attachment of the paper web, to a turn-up position placing the turn-up tape in a position to attach to a second spool during a turn-up procedure.

4. The apparatus of claim 3 additionally comprising a flexible track portion between the transverse turn-up tape track and the track curve, wherein the flexible track portion is adjustable to move the track curve from the lower vertical position to the turn-up position, while the transverse turn-up tape track remains essentially stationary relative to the first spool.

5. The apparatus of claim 4 additionally comprising a sensor to detect a distance from a center of the first spool receiving the paper web to an edge of the paper web.

6. The apparatus of claim 5 additionally comprising automation operative to ascertain whether the track curve is properly positioned for the turn-up procedure on the paper web with the distance detected from the center of the first spool receiving the paper web to the edge of the paper web.

7. An apparatus for variable width turn-up procedures on a paper processing machine, the apparatus comprising:

a) a transverse track mounted on a first linear bearing and extended across a surface of a first spool for receiving a paper web, wherein said transverse track is movable along the first linear bearing and sized to contain a paperband;

b) a paperband dispenser fixedly attached to a proximal end of the transverse track and movable with the transverse track along the first linear bearing;

c) a track curve attached to a distal end of the transverse track;

d) a movable turn-up tape exit point mounted to a second linear bearing, wherein said second linear bearing is attached to a linear track independent of the transverse track; and e) a brake operable to secure the transverse track in a position relative to the surface of the first spool during a turn-up procedure.

8. The apparatus of claim 7 additionally comprising a securing device for releasably securing the movable turn-up tape exit point in a position during the turn-up procedure.

9. The apparatus of claim 8 additionally comprising a turn-up tape exit point track support fixedly attached to a floor surface supporting the paper processing machine.

10. The apparatus of claim 7 additionally comprising a mobility enhancer supporting the paperband dispenser and the transverse track.

* * * * *